United States Patent [19]

Galle, Jr.

[11] 4,451,056

[45] * May 29, 1984

[54] REMOTELY OPERATED UNDERWATER TENSION CONNECTOR

[75] Inventor: Edward M. Galle, Jr., Houston, Tex.

[73] Assignee: Armco Inc., Middletown, Ohio

[ * ] Notice: The portion of the term of this patent subsequent to Feb. 21, 2001 has been disclaimed.

[21] Appl. No.: 170,970

[22] Filed: Jul. 18, 1980

[51] Int. Cl.[3] ..... F16L 35/00

[52] U.S. Cl. ..... 285/3; 285/24; 285/86; 285/307; 285/315; 285/330; 285/DIG. 21; 114/265; 405/224

[58] Field of Search ..... 285/18, 315, 3, 137 A, 285/86, DIG. 21, 24, 27, 330, 321, 307, 308, 141; 166/212; 405/202, 206, 208, 224; 114/265

[56] References Cited

U.S. PATENT DOCUMENTS

| | | | |
|---|---|---|---|
| Re. 26,668 | 9/1969 | Word et al. | 166/344 X |
| 2,962,096 | 11/1960 | Knox | 285/DIG. 7 |
| 3,222,088 | 12/1965 | Haeber | 285/93 X |
| 3,228,715 | 1/1966 | Neilon et al. | 285/313 |
| 3,240,511 | 3/1966 | Bishop et al. | 285/315 X |
| 3,648,638 | 3/1972 | Blenkarn | 405/202 X |
| 3,654,886 | 4/1972 | Silverman | 405/202 X |
| 3,731,955 | 5/1973 | Borsum et al. | 285/307 X |
| 3,887,222 | 6/1975 | Hammond | 285/307 |
| 3,955,521 | 5/1976 | Mott | 114/265 |
| 3,976,021 | 8/1976 | Blenkarn | 405/208 |
| 3,996,755 | 12/1976 | Kulinowski | 166/358 X |
| 4,080,868 | 3/1978 | Matthews | 89/1.806 |
| 4,086,776 | 5/1978 | Beard | 405/185 |
| 4,167,970 | 9/1979 | Cowan | 285/141 X |
| 4,290,483 | 9/1981 | Lawson | 285/3 X |
| 4,320,993 | 3/1982 | Hunter | 405/224 |

FOREIGN PATENT DOCUMENTS

| | | | |
|---|---|---|---|
| 2033463 | 5/1980 | United Kingdom | 285/307 |

*Primary Examiner*—Dave W. Arola

*Attorney, Agent, or Firm*—Roylance, Abrams, Berdo & Goodman

[57] ABSTRACT

A tension connector, and offshore platform mooring system embodying the connector, characterized in that the connector can be made up remotely and released remotely. The connector comprises a male connector member, typically attached to a string of pipe which serves as a mooring element, and a female connector member, typically secured to an anchoring base at the bottom of a body of water. The connector is made up simply by inserting the male member downwardly into the female member by manipulating the pipe string. Advantageously, two remote release means are provided, one operating hydraulically, the other by manipulation of the pipe string.

21 Claims, 21 Drawing Figures

FIG. 6
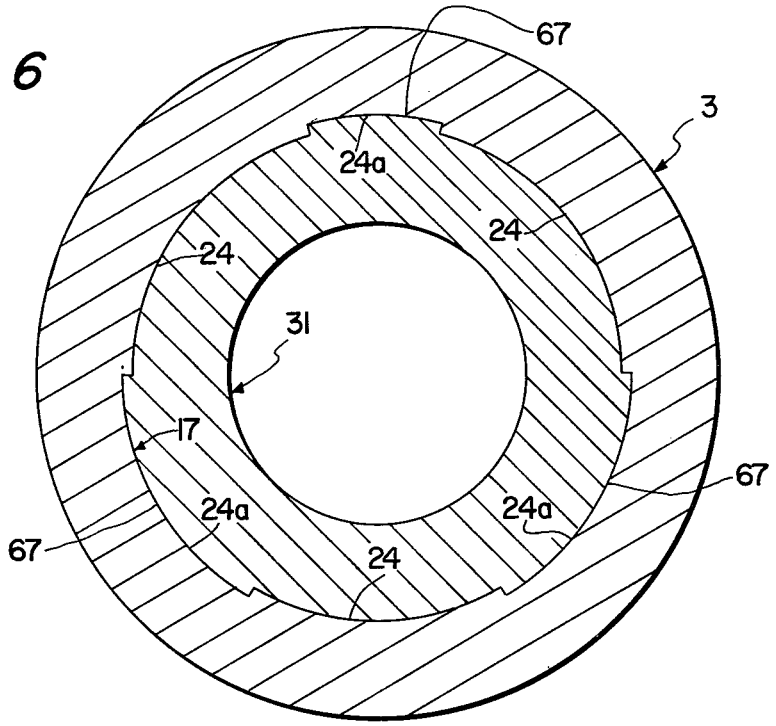
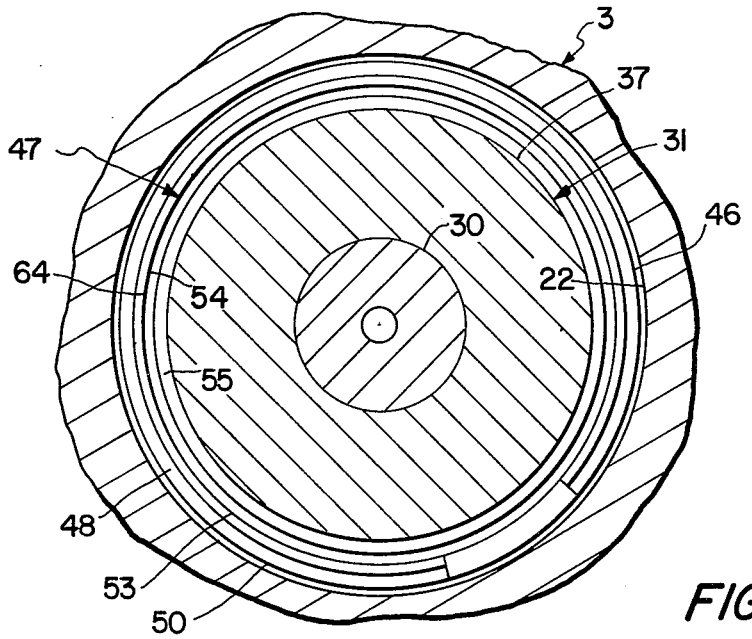
FIG. 7

REMOTELY OPERATED UNDERWATER TENSION CONNECTOR

BACKGROUND OF THE INVENTION

With the development of the art of drilling oil and gas wells under water, it has become common practice to employ underwater connectors which can be made up and released by operations carried out from a location remote from that of the connector. Thus, in the earliest stages of development of the art, it was necessary to couple wellhead members together remotely, and remotely operated connectors for that purpose were provided, as shown for example in U.S. Pat. Nos. 3,222,088 to Haeber and 3,228,715 to Neilon et al. With further development of the art, it became necessary to connect concentric well pipes remotely, by connectors capable of being located in a relatively small annulus, as seen for example in U.S. Pat. No. 4,167,970 to Cowan. Other remote connection problems have arisen in drilling and completion of underwater wells, as in the connection of umbilical lines (U.S. Pat. No. 4,086,776 to Beard) and the connection of flow lines (U.S. Pat. No. Re 26,668 to Word). The loads to be transmitted by such connectors have in some cases been relatively large, a maximum load on the order of $\frac{1}{3}$ million pounds being typical when multiple tubing strings are to be supported by the connector. While prior-art connectors have been successful and widely used for such purposes, more recent developments in the art have imposed even greater demands, particularly for capabilities of withstanding much larger forces. One example of the recent developments is the need to remotely attach the tension elements of a tension leg platform or the mooring elements of a vertically moored platform to an anchor structure secured to the floor of a body of water. Such platforms are disclosed, for example, in U.S. Pat. Nos. 3,648,638 to Blenkarn, 3,654,886 to Silverman, 3,976,021 to Blenkarn et al, 3,955,521 to Mott and 3,996,755 to Kalinowski. In such platforms, each leg may comprise a number of tension members, each tension member typically being a string of pipe. The design maximum tension load per tension member may be in excess of 6 million pounds, and that load must of course be accepted by the connector used to attach the tension member to the anchor structure. Provision of remotely operable connectors suitable for such purposes is complicated by the fact that remote connection must be accomplished with certainty and precision, to assure that load-bearing shoulders are in fact properly and fully mated, and remote release of the connector must also be accomplished with certainty since, for example, tension elements of the legs of a tension leg platform must be retrieved periodically for inspection.

OBJECTS OF THE INVENTION

A general object of the invention is to devise a remotely connectable and remotely releasable connector capable of withstanding very large tension loads.

Another object is to provide such a connector which can be made up or connected simply by inserting a male connector member into a female connector member but in which precise mating of the load-bearing shoulders is assured.

A further object is to provide such a connector which provides a maximum of assurance that the connector can be released by remotely accomplished operations.

Yet another object is to devise such a connector having redundant remote release capabilities.

A still further object is to provide, in a tension leg platform, the combination of a tension leg element and remotely operable connector of such nature that the connector can be remotely made up and released solely by manipulation of the tension leg element from the platform.

SUMMARY OF THE INVENTION

Connectors according to the invention comprise a male connector member and a female connector member. One of the connector members is connected rigidly to an upper member, such as a string of pipe to be used as a tension element of a leg of a tension leg platform, and the other connector member is connected rigidly to a lower member, such as the anchor base to which the leg of a tension leg platform is to be attached. The female connector member has an axial bore which opens through a frustoconical entry guide surface at one end of the member and which includes a frustoconical first load-bearing shoulder spaced from the entry guide surface and tapering in the opposite direction. The male connector member has a transverse annular outwardly opening recess defined at one end by a second load-bearing shoulder which is opposed to the first load-bearing shoulder when the two members are fully engaged telescopically. Disposed in the outwardly opening recess of the male member is an annular stop means, typically a split ring, which is radially distortable resiliently between an outer active position and an inner inactive position, the annular stop means being resiliently biased toward its outer position and presenting third and fourth load-bearing shoulders, the third load-bearing shoulder being frustoconical to mate with the first shoulder, the fourth shoulder being disposed to mate with the second load-bearing shoulder. The connector members and the annular stop means have coacting means operative to contract the stop means toward its inactive position as a result of telescopic engagement of the two members, the stop means being constrained to a retracted position until progressive telescopic engagement of the two members has brought the stop means to an axial position in the bore of the female member such that the stop means springs outwardly as a result of its bias and causes the third load-bearing surface to engage the first load-bearing shoulder. At this point, contraction of the stop means is prevented, as by positive insertion of blocking means or by interaction between the four load-bearing shoulders, and axial separation of the two connector members under tension is prevented by engagement of the first and third load-bearing shoulders so that the connector can now accept loads in tension. Remotely operable means is provided for releasing the connector and includes means carried by the male member for at least conditioning the annular stop means for release, as by retraction of the blocking means when a blocking means is used. Thus, in particularly advantageous embodiments, a primary release mode includes unblocking the annular stop means and then applying a strain in tension so that the first and third load-bearing shoulders coact in camming fashion to contract the stop means until the connector members can be disengaged. In other embodiments, annular piston means carried by the male member is operated to positively contract the stop means. For redundancy of the releasing operation, a second release mechanism is included which comprises coacting elements carried by both connector members and brought into play by remote manipulations carried out to accomplish predetermined relative movement between the two connector members.

IDENTIFICATION OF THE DRAWINGS

In order that the manner in which the foregoing and other objects are achieved according to the invention can be understood in detail, particularly advantageous embodiments thereof will be described with reference to the accompanying drawings, which form a part of the original disclosure of this application, and wherein:

FIG. 6 is a transverse sectional view taken generally on line 6—6, FIG. 5B, when the male connector member occupies its lowest position within the female member;

FIG. 7 is a transverse sectional view taken generally on line 7—7, of FIG. 2, but reduced in scale relative to FIGS. 2 and 6;

DETAILED DESCRIPTION OF THE EMBODIMENT OF FIGS. 1–7

Figure 1:
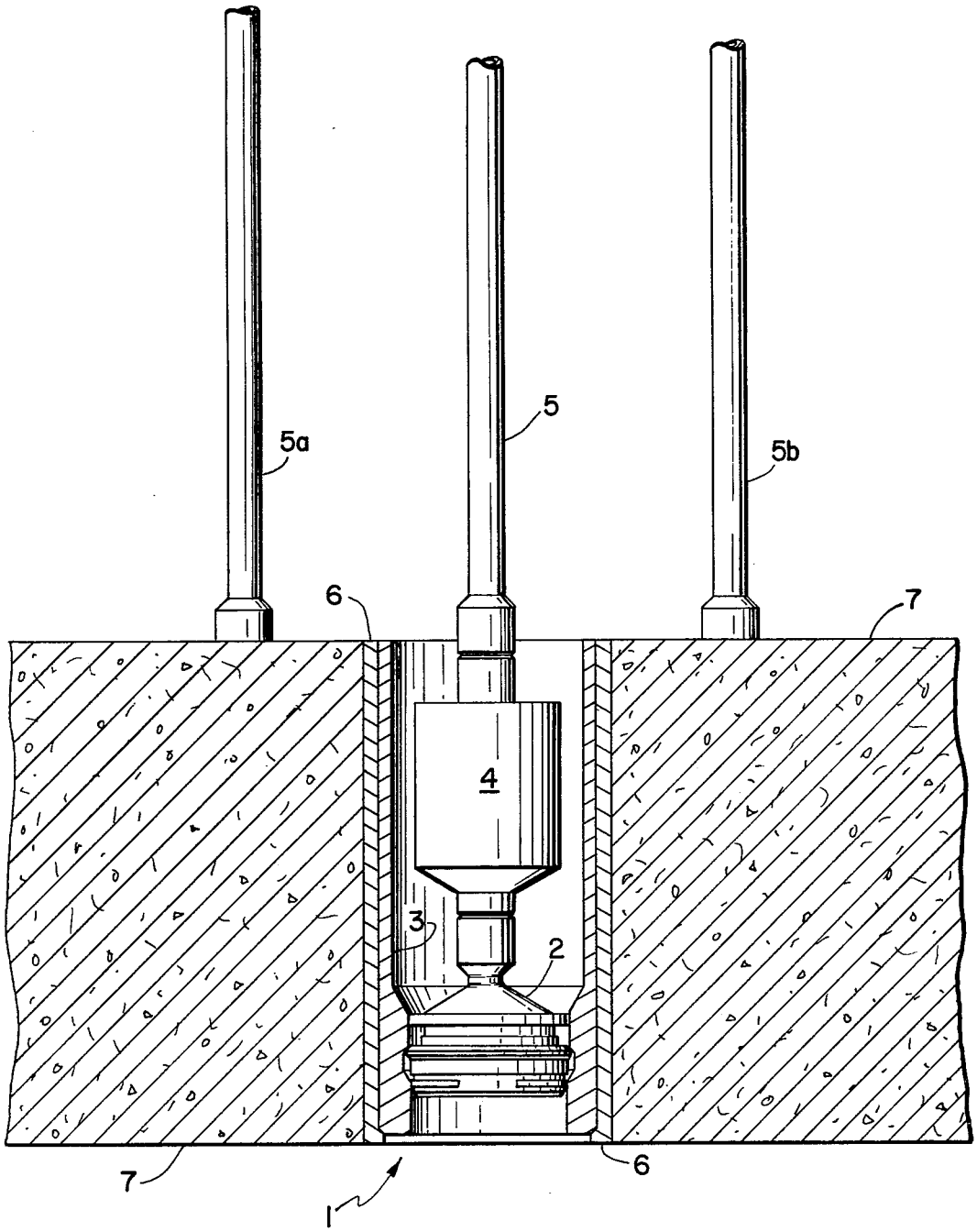
FIG. 1 is a view, partly in side elevation and partly in vertical cross section, of a connector according to one embodiment of the invention connecting one tension element of a leg of a tension leg platform to an anchoring base.
Figure 2:
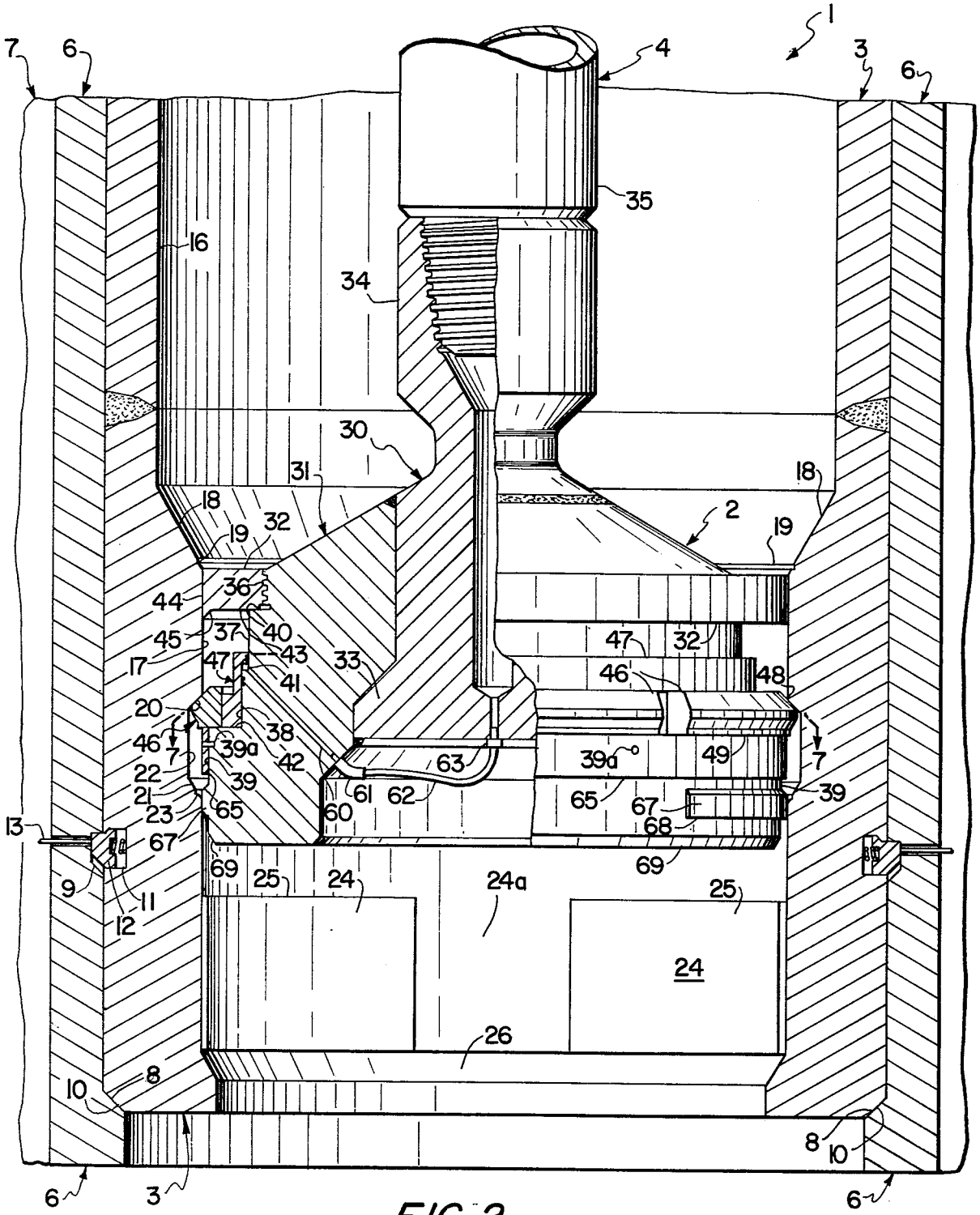
FIG. 2 is a fragmentary vertical sectional view, enlarged relative to FIG. 1 and with some parts shown in elevation, showing a portion of the connector of FIG. 1 in its connected position.

As seen in FIG. 1, the connector 1 of this embodiment comprises a male connector member 2 and a female connector member 3. Male connector member 2 is rigidly secured, as by a threaded joint, to the lower end of a conventional flex joint 4 forming part of one elongated tension element 5 of one leg of a tension leg platform (not shown). The leg may comprise additional tension elements 5*a* and 5*b* which is identical to element 5 and each equipped with a connector (not shown) identical to connector 1. As seen in FIG. 2, female connector member 3 is generally tubular and embraced by a tubular receptacle 6 rigidly secured to and forming part of the anchoring base 7 to which the platform leg is attached. Receptacle 6 presents a transverse annular upwardly facing shoulder 8 and has a transverse annular inwardly opening lock groove 9. Female connector member 3 has a transverse annular downwardly facing shoulder 10 to be landed on shoulder 8. Member 3 also has a transverse annular outwardly opening groove 11 accommodating an annular series of locking segments 12 which are spring-biased outwardly into engagement with groove 9. Base 7 is equipped with a plurality of hydraulically actuated plungers 13 each arranged for radial movement, relative to the connector 1, for positive retraction of segments 12 when it is desired to recover the female connector member.

Connector member 3 is considerably elongaged and includes an upper bore portion 16, of larger diameter to accommodate flex joint 4, and a lower bore portion 17 or smaller diameter, bore portions 16 and 17 being joined by a downwardly and inwardly tapering frustoconical surface 18 serving as an entry guide surface at the upper end of bore portion 17. Near its inner periphery, guide surface 18 is interrupted by a transverse annular notch 19 of right triangular radial cross section, the outer wall of the notch being cylindrical and concentric with bore portion 17, the other wall of the notch lying in a plane at right angles to the longitudinal central axis of member 3. In a location spaced below guide surface 18, bore portion 17 includes a transverse annular inwardly opening groove defined by an upper shoulder 20, a lower shoulder 21 and a cylindrical outer wall 22. Upper shoulder 20 is a frustoconical downwardly facing first load-bearing shoulder which tapers upwardly and inwardly. Lower shoulder 21 faces upwardly, tapers downwardly and inwardly at the same angle as does entry guide surface 18, and is provided with a transverse annular notch 23 identical to notch 19.

At a predetermined distance below shoulder 21, the right cylindrical wall of bore portion 17 is interrupted by three circumferentially spaced inwardly projecting splines 24, the splines being rectangular in side elevation so that each adjacent pair of splines 24 define an axially extending guideway 24*a*. Splines 24 have flat upper end faces 25 lying in a common plane at right angles to the axis of the bore. The splines extend downwardly for a predetermined distance below the plane of shoulders 25 and, at the lower ends of the splines, an upwardly facing transverse annular stop shoulder 26 is provided.

Male connector member 2 comprises a central stem 30, an annular body 31 and a ring 32. Stem 30 includes an external flange 33, at the bottom of the stem, and a threaded socket 34 located at the top of the stem and connected to the male threaded end portion 35 of flex joint 4 or, alternatively, directly to the male threaded end of the lowermost joint of pipe making up the tension member. Annular body 31 has an inner periphery such as to snugly embrace the lower portion of stem 30, including flange 33, and is welded to the stem above and below the flange, as shown in FIG. 2, so stem 30 and annular body 31 are rigidly secured to each other.

The outer surface of annular body 31 includes an upper threaded portion 36 of smaller diameter, a first right cylindrical portion 37 located below and a larger diameter than the threaded portion, a second right cylindrical portion 38 located below and of larger diameter than portion 37, and a third right cylindrical portion 39 located below portion 38. An upwardly facing transverse annular shoulder 40 joins portions 36 and 37.

Portions 37 and 38 are joined by an upwardly facing transverse annular shoulder 41. Portions 38 and 39 are joined by a transverse annular upwardly facing shoulder 42. Ring 32 is internally threaded to cooperate with portion 36 to secure the ring to annular member 31 with the flat bottom face 43 of the ring seated on shoulder 40. The outer surface 44 of the ring is right cylindrical and of a diameter slightly smaller than that of bore portion 17. At its outer periphery, ring 32 has a dependent annular lip presenting an upwardly and inwardly tapering frustoconical camming surface 45. Ring 32, surface portions 37 and 38, and shoulders 41 and 42 combine to define a transverse annular outwardly opening recess which accommodates the annular stop means, in this embodiment a resilient split ring 46, and an annular piston 47 serving as blocking means for the split ring.

Figure 3:
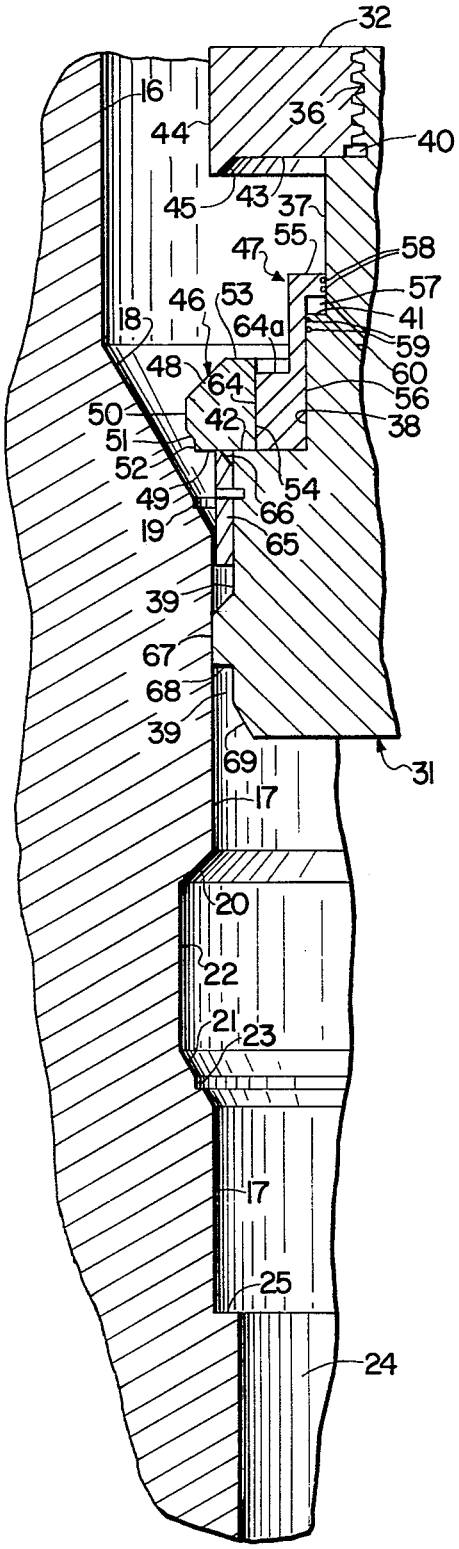
FIGS. 3–3D are fragmentary vertical sectional views illustrating successive relative positions occupied by parts of the connector as the connector is connected by remote operations.

Shoulder 42 constitutes a second load-bearing shoulder. Split ring 46 presents a third load-bearing shoulder 48 and a fourth load-bearing shoulder 49. Shoulder 48 faces upwardly, is frustoconical and tapers upwardly and inwardly at the same angle as does the first load-bearing shoulder 20, presented by member 3. Shoulder 49 is a flat transverse annular shoulder capable of mating with shoulder 42. As best seen in FIG. 3, split ring 46 also presents an axially short right cylindrical outer surface portion 50, a frustoconical outer surface portion 51 which tapers downwardly and inwardly at the same angle as does entry guide surface 18 of member 3, and a right cylindrical outer surface portion 52 of the same axial length as the outer wall of notch 19. The split ring is completed by a flat transverse annular upper surface 53 and a right cylindrical inner surface 54.

In a typical connector for attaching tension element 5 of a tension leg platform to an anchoring base, split ring 46 can have an outer diameter of approximately 45.25 in. (1149 mm.) and a weight of, e.g., 750 lbs. (340.9 kg.). When split ring 46 is in its completely relaxed and undistorted condition, its diameter is such that the diameter of cylindrical outer surface portion 52 can be slidably embraced by the cylindrical wall of notch 19. Before the male connector member 2 is inserted downwardly into female member 3, ring 46, due to its weight, occupies the position seen in FIG. 3, with the inner portion of shoulder 49 seated on the outer portion of shoulder 42. It will be noted that the axial distance between surfaces 49 and 53 of ring 46 is small as compared to the space between shoulder 42 and surface 43 so that, unless otherwise constrained, ring 46 is allowed a substantial axial excursion relative to member 2.

Piston 47 is an integral ring having an upper inwardly projecting transverse annular flange 55, which slidably embraces surface portion 37, and a body portion having a right cylindrical inner surface 56, which slidably embraces surface portion 38. Axially, inner surface 56 of the piston is significantly longer than is surface portion 38 so that, when the piston is seated on shoulder 42, flange 55 of the piston is spaced above shoulder 41 to provide an annular expansible chamber 57. The inner surface of flange 55 is equipped with seal rings at 58 to seal between surface 37 and flange 55. Member 31 is provided with seal rings at 59 to seal between surfaces 38 and 56. A bore 60 extends through member 31 to communicate with expansible chamber 57. As seen in FIG. 2, the end of bore 60 opposite the expansible chamber is connected via fitting 61, conduit 62 and fitting 63 to the bore of stem 30 and thus with the bore of the pipe constituting tension element 5 so that pressure fluid to drive piston 47 can be supplied from, e.g., the tension leg platform. The lower end portion of piston 47 is outwardly enlarged and presents a cylindrical outer surface 64 to be embraced by split ring 46 when the ring is relaxed and undistorted and the parts are in the positions shown in FIG. 3. The outwardly enlarged lower end portion of piston 47 presents an upwardly directed flat transverse annular shoulder 64*a*.

Figure 3A:
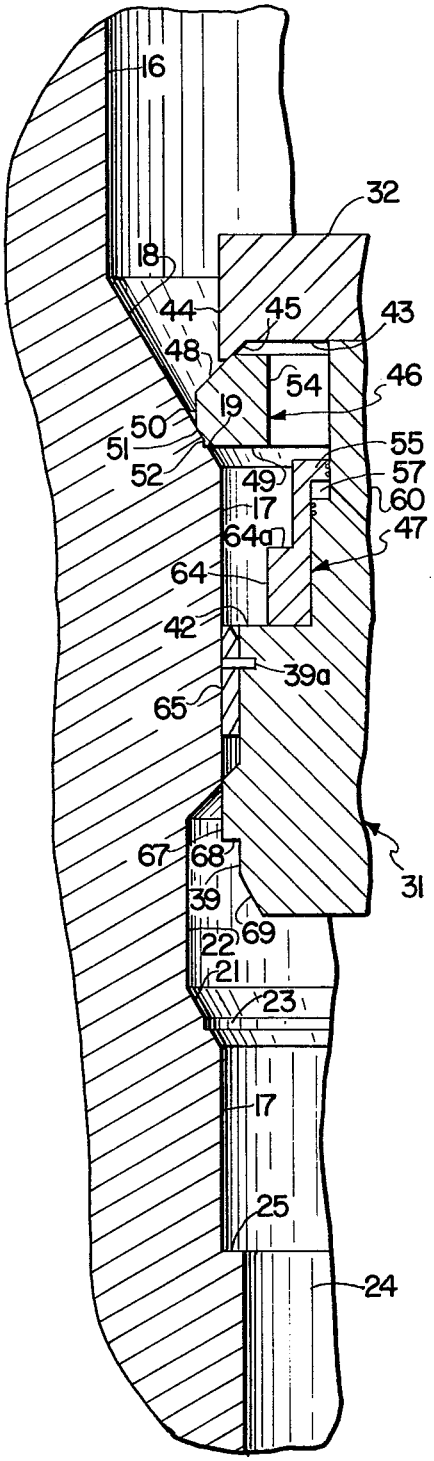

Below shoulder 42, a closed ring 65 loosely embraces the upper portion of surface 39 and is equipped with shear pins 39*a* to assure that ring 65 remains in place on body 31 until forcibly displaced in the manner later described. It will be noted that the diameter of surface 39 is significantly less than that of bore portion 17 to accommodate the relatively small radial thickness of ring 65 between surface 39 and the wall of the bore, as seen in FIGS. 3 and 3A. At its upper end, the inner corner of ring 65 is chamferred to provide a frustoconical camming surface 66 which tapers downwardly and inwardly at the same angle as does outer surface portion 51 of split ring 46.

Below ring 65, surface 39 is interrupted by three arcuate outwardly projecting splines 67 integral with body 31 and spaced in an annular series which is circumferential with respect to body 31. The arcuate extent of each spline 67 is such that each spline 67 can pass downwardly into one of the guideways 24*a*, FIG. 2, when male connector member 2 is in a predetermined rotational position relative to female member 3. Typically, two of the splines 24 of member 3 extend for 75° and one for 60°, and spines 24 are so spaced apart that two of guideways 24*a* extend circumferentially for 60° and one guideway 24*a* extends for 30°, as seen in FIG. 6. With member 3 formed in that fashion, one of the splines 67 extends for slightly less than 30°, so as to be capable of passing through the 30°-guideway 24*a*, and the other two splines 67 extend circumferentially slightly less than 60°, so as to be capable of passing each through a different one of the 60°-guideways 24*a*. Hence, splines 67 can enter guideways 24*a* only when male connector member 2 is in one predetermined rotational position relative to member 3. The lower end of each spline 67 is defined by a flat arcuate face 68, all of the faces 68 lying in a common plane at right angles to the longitudinal axis of member 2 so that, when member 2 does not occupy the one predetermined rotational position relative to member 3 in which splines 67 are aligned to enter the respective guideways 24*a*, the faces 68 will land on the upper end faces 25 of splines 24 and prevent further downward movement of member 2 within member 3. At its bottom end, body 31 has a frustoconical peripheral shoulder 69 tapering downwardly and inwardly at the same angle as does stop shoulder 26.

Figure 3B:
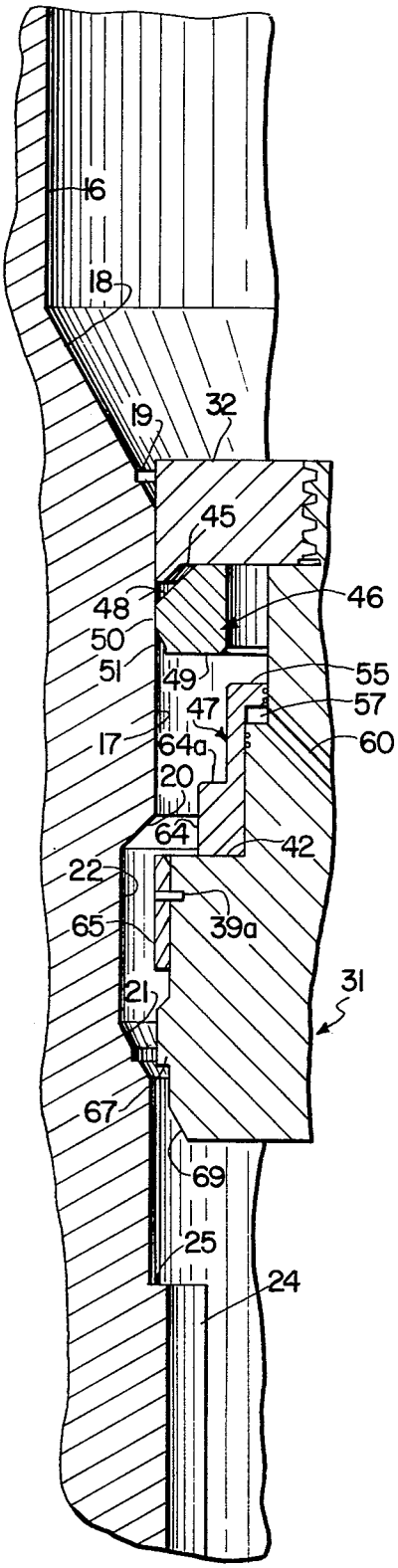

Female connector member 3 can be installed in receptacle 6 before anchoring base 7 is installed. In that case, tension element 5, with male connector member 2 and flex joint 4 having been attached at the surface, is lowered with the aid of conventional guide means (not shown) to guide male connector member 2 into female member 3. Centered with respect to receptacle 6 and member 3 by the guide means, member 2 is approximately centered on bore portion 17 as the lower end of body 31 approaches guide surface 18 and any misalignment is corrected by coaction of shoulder 69 with guide surface 18. Accordingly, as seen in FIG. 3, body 31 of member 2 enters bore portion 17. At this stage, split ring 46 rests on shoulder 42 and is in its relaxed position. Piston 47 also rests on shoulder 42. Since split ring 46 is relaxed, continued downward travel of member 2 causes the split ring to seat on surface 18 and in annular notch 19, as seen in FIG. 3A, with the result that the split ring is stopped in centralized position relative to bore portion 17 while body 31 continues its downward movement and surface 45 of ring 32 comes into embracing engagement with surface 48 of the split ring. Since the split ring cannot move downwardly because the outer peripheral portion of shoulder 49 is seated on the bottom wall of notch 19 and surface 51 is engaged with surface 18, further downward movement of member 2 causes surfaces 45 and 48 to coact and cam ring 46 radially inwardly so that the split ring is contracted to a smaller diameter and surface 52 of the split ring comes into sliding engagement with guide surface 18. Concurrently, upper surface 53 of the split ring is engaged by surface 43 of ring 32. Further downward movement of member 2 therefore causes split ring 46 to be forced radially inwardly until surface 50 of the split ring is slidably embraced by the wall of bore portion 17, as seen in FIG. 3B. At this stage, resilience of the split ring causes the ring to be in forceable engagement with the wall of bore portion 17, so that the friction of that engagement prevents the heavy split ring from falling and maintains engagement between the split ring and ring 32 as downward travel of member 2 continues.

Figure 3C:
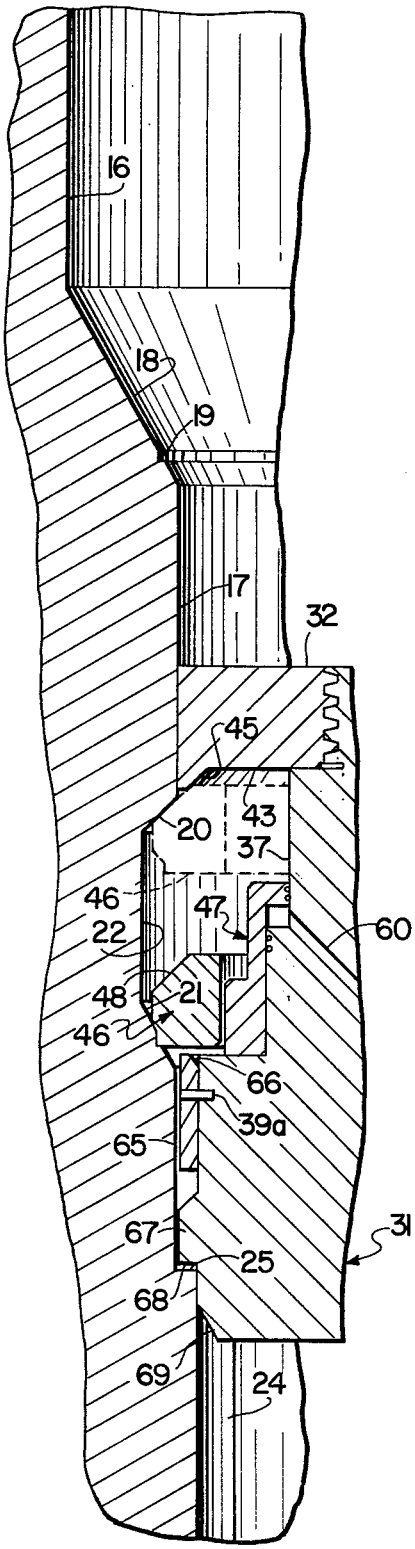

As ring 32 approaches shoulder 20, as seen in FIG. 3C, split ring 46 reaches a point in its downward travel where surface 48 of the split ring is opposed to shoulder 20. The split ring is therefore allowed to expand resiliently to its relaxed position. By comparing FIGS. 3B and 3C, it will be seen that, at this stage, split ring 46 is spaced radially inwardly from surface 45 and is therefore not retained by surface 45. Accordingly, the heavy split ring not only expands to its relaxed condition but also drops relative to body 31, coming to rest on shoulder 21, with the corner of the ring engaged in annular notch 23, as seen in solid lines in FIG. 3C. A small additional downward movement of member 2 causes surfaces 68 to seat on surfaces 25, giving positive indication of full engagement of male member 2 in female member 3.

Figure 3D:
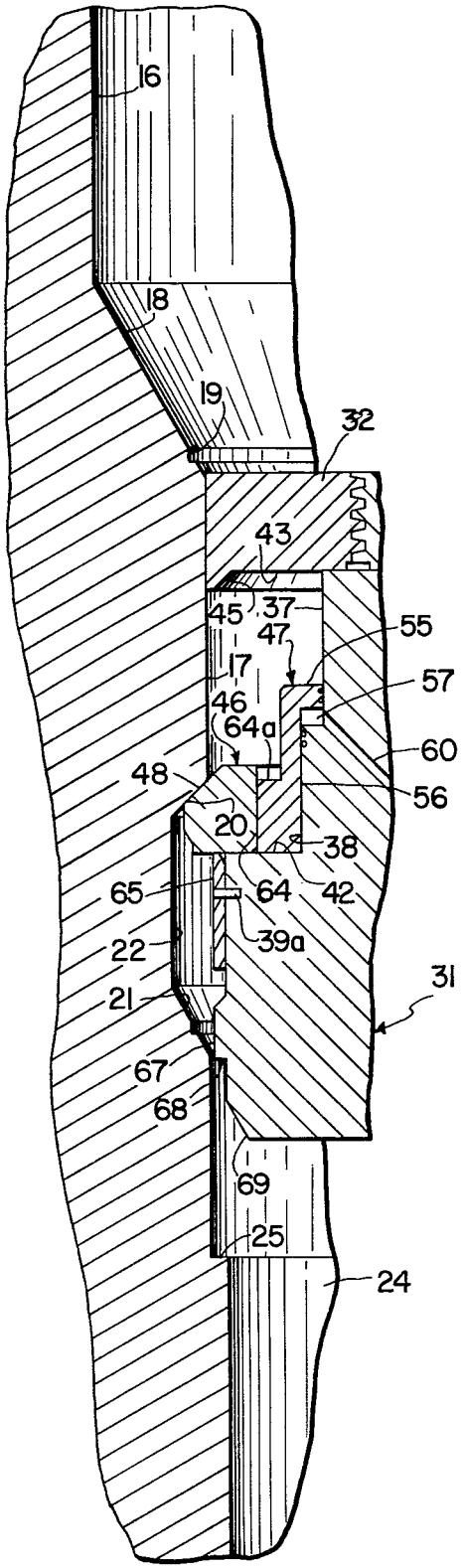

Application of an upward strain on the tension element 5 now causes the parts of connector 1 to assume the positions seen in FIG. 3D, with shoulder 49 of split ring 46 engaged by shoulder 42 and with shoulder 48 of the split ring engaging shoulder 20 of member 3. Piston 47 has remained seated on shoulder 42 and is therefore embraced by split ring 46, presence of the piston blocking the split ring from being contracted. With shoulders 20, 48 both tapering at approximately 45°, the tension load is transmitted along lines at right angles to surfaces 20, 48, and with the enlarged lower portion of piston 47 blocking contraction of the split ring, the force transmittal is primarily in compression. So long as element 5 remains under tension, connector members 2 and 3 remain connected in tension as seen in FIG. 3D.

Figure 4:
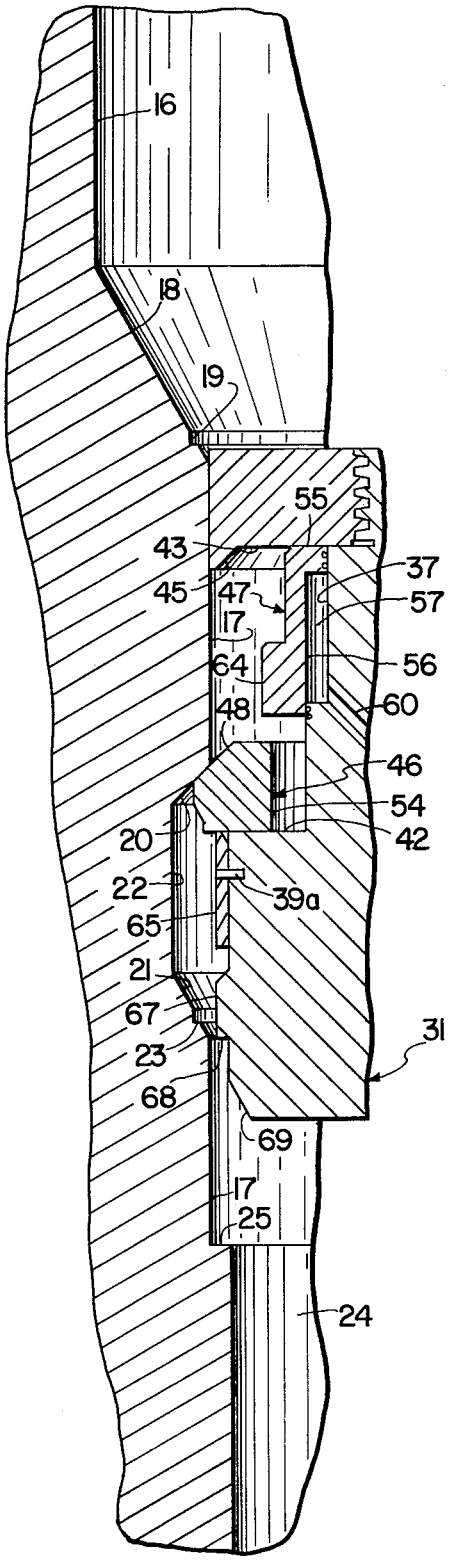
FIGS. 4 and 4A are fragmentary vertical sectional views showing relative positions occupied by parts of the connector as the connector is disconnected remotely according to its primary release mode.
Figure 4A:
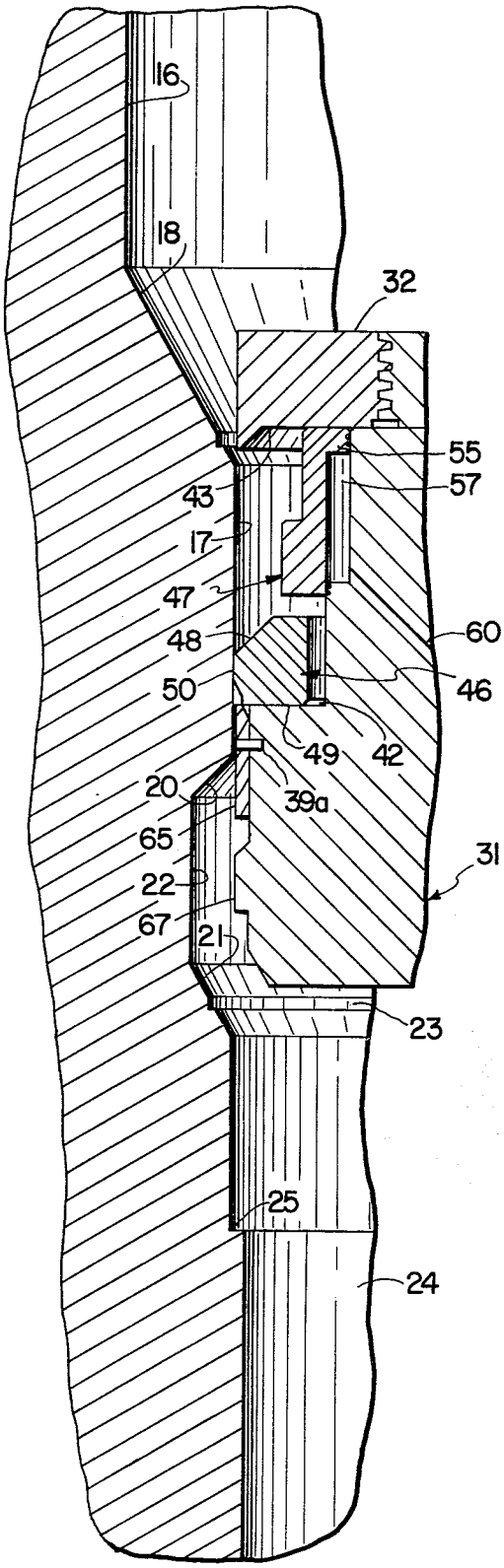

When connector 1 is to be released, as when tension element 5 is to be recovered for inspection, hydraulic fluid under pressure is supplied via the bore of the string of pipe making up element 5, the pressure fluid flowing via fitting 63, conduit 62, fitting 61 and duct 60, FIG. 2, to the expansible chamber 57 defined by piston 47 and member 31. As illustrated in FIG. 4, supply of pressure fluid to chamber 57 drives piston 47 upwardly from its blocking position (FIG. 3D) to an inactive position (FIG. 4). The raised or inactive position is determined by engagement of upper flange 55 of the piston with bottom face 43 of ring 32. With the piston in its inactive position, the lower end of the piston is spaced well above split ring 46 and the split ring is therefore free to be contracted. Thus, application of an upward strain on tension element 5 causes shoulders 20 and 48 to coact in camming fashion so that split ring 46 is progressively contracted (compare FIGS. 3D, 4 and 4A) until outer surface 50 of the split ring is embraced by the wall of bore portion 17 above shoulder 20 and male connector member 2 is free to be withdrawn upwardly out of female connector member 3. Preparatory to supply of pressure fluid via duct 60 to raise piston 47, frictional engagement between split ring 46 and the blocking piston can be reduced by relaxing the tension on element 5. It will be apparent that, once connector member 2 has been moved upwardly to such an extent that split ring 46 is no longer embraced by the wall of bore portion 17, the split ring will return to its normal relaxed position, as in FIG. 3, so that, if chamber 57 is vented via duct 60, piston 47 can return by gravity to its blocking position within the split ring.

Figure 5:
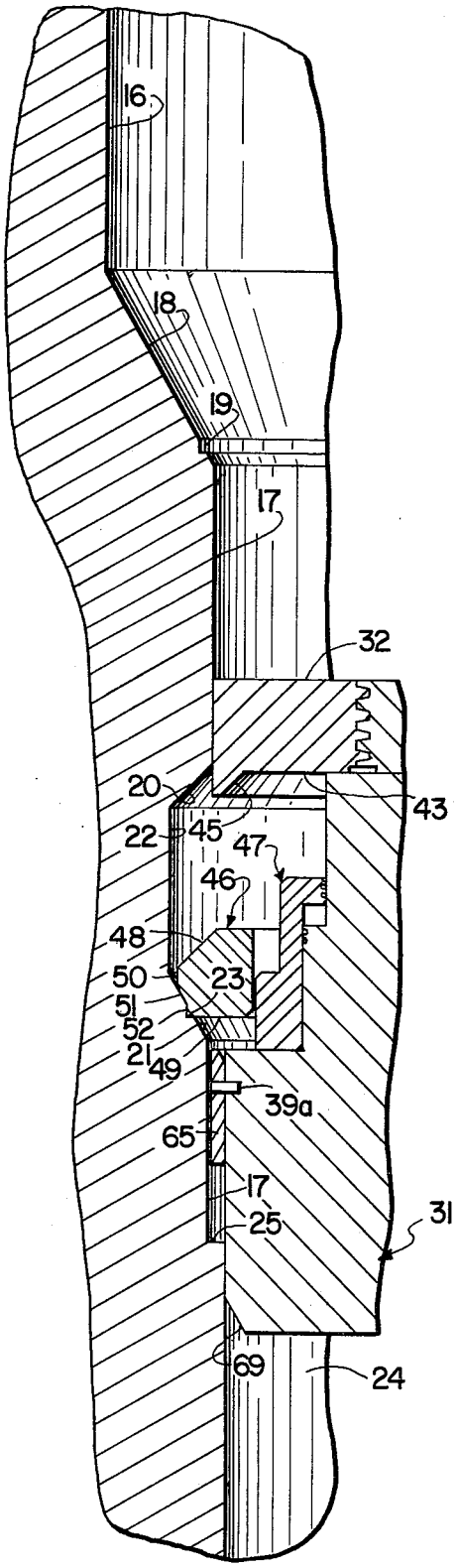
FIGS. 5–5D are fragmentary vertical sectional views showing relative positions occupied by parts of the connector as the connector is disconnected remotely according to its secondary release mode.
Figure 5A:
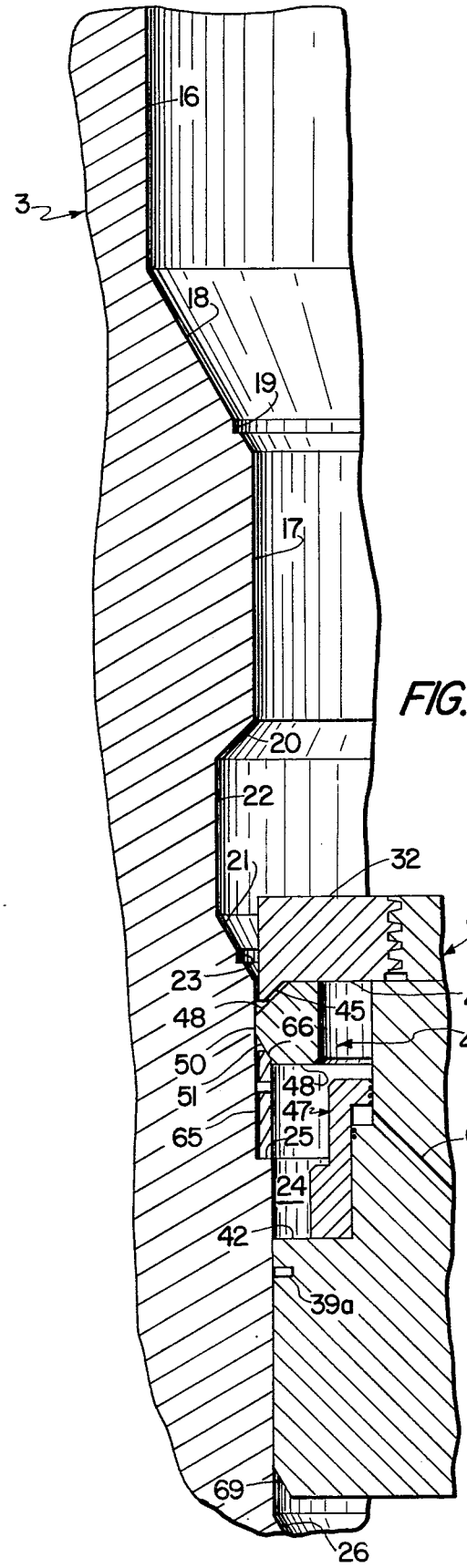
Figure 5B:
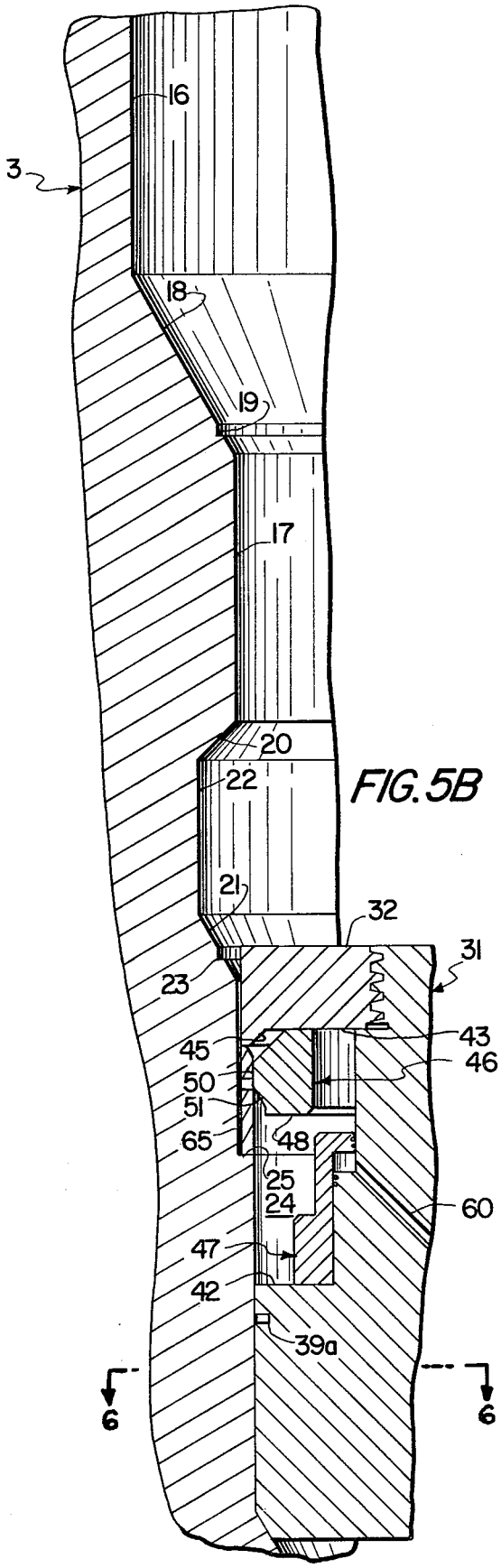
Figure 5C:
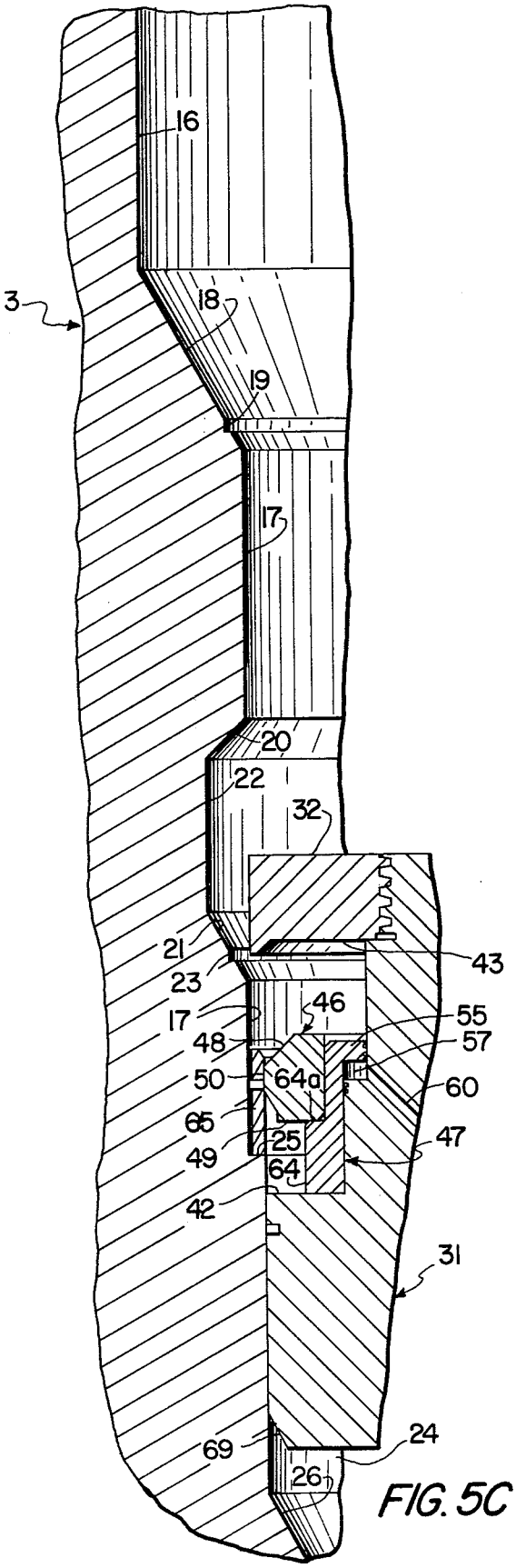
Figure 5D:
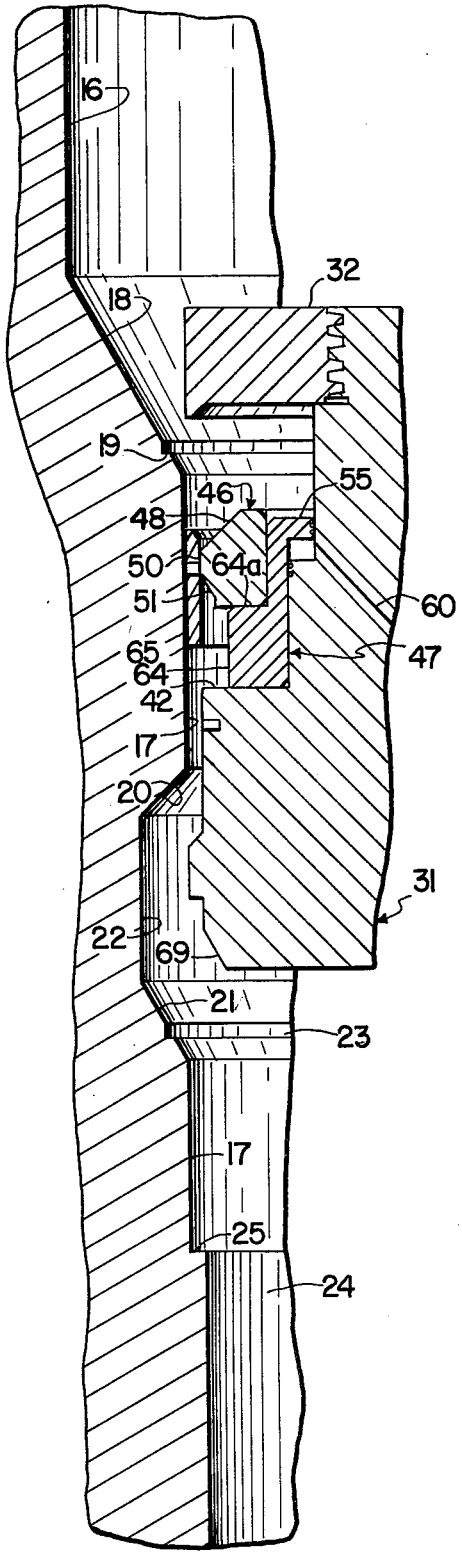

Should application of pressure fluid to chamber 57 fail to raise piston 47 fully to its inactive position, connector 1 can still be released remotely by employing the secondary release mode illustrated in FIGS. 5–5D. Preliminary to explanation of the secondary release mode, it should be noted that the outer surfaces of splines 67 of body 31 lie in a right cylindrical plane having a diameter only slightly smaller than that of bore portion 17. Accordingly, until male splines 67 are registered with the guideways **24*a* defined by female splines 24, downward travel of connector member 2 beyond the position seen in FIG. 3C is promptly stopped by engagement of the lower faces 68 of splines 67 with the upper surfaces 25 of splines 24. Accordingly, the first step of the secondary release mode is rotation of male connector member 2, by manipulating tension element 5, until male splines 67 are aligned with the respective guideways 24*a* so that, as seen in FIG. 5, body 31 can continue to move downwardly within female connector member 3. At this stage, ring 65, which has an outer diameter only slightly smaller than that of bore portion 17, is still spaced above the common plane of shoulders 25. With male splines 67 entering guideways 24*a*, ring 32 occupies a position such that its bottom face 43 is below the upper end of shoulder 20, leaving split ring 46 free to expand into the space defined by the groove comprising shoulders 20, 21 and surface 22. Thus expanded, ring 46 falls to seat on shoulder 21, with surfaces 52, 49 of the split ring engaging in the annular notch 23**, as shown in FIG. 5.

Continued downward movement of body 31, resulting from continued descent of tension element 5, causes surface 45 of ring 32 to come into engagement with surface 48 of the split ring, so that surfaces 45, 48 coact in camming fashion to contract the split ring until the split ring can be carried downwardly into bore portion 17 below shoulder 21, with outer surface 50 of the split ring now being slidably embraced by the wall of bore portion 17 in the manner seen in FIG. 5A. Further downward movement of body 31 causes ring 65 to land on shoulders 25, with ring 65 then being displaced, relative to body 31, to bring surface 66 into engagement with outer surface 51 of the split ring. With downward movement of ring 65 prevented by shoulders 25, further downward movement of body 31 causes surfaces 51, 66 to coact in camming fashion to contract split ring 46 and cause the split ring to enter and be embraced by ring 65 in the manner seen in FIG. 5B. Downward movement of body 31, and thus of connector member 2 and tension element 5, is positively stopped by engagement of peripheral shoulder 69 of body 31 with stop shoulder 26 of member 3 at a time just before the dependent peripheral lip of ring 32 comes into forcible engagement with the upper end of ring 65.

Tension element 5 is now pulled upwardly to withdraw male connector member 2 from female member 3, with split ring 46 held contracted and inactive by ring 65. Since split ring 46 is held contracted by ring 65, initial upward movement of body 31 causes shoulder 64*a* of piston 47 to engage the bottom shoulder 49 of split ring 46, as seen in FIG. 5C. Since there is a tight fit between split ring 46 and ring 65, due to the spring force of the contracted split ring, and since the outer diameter of ring 65 is slightly smaller than that of bore portion 17, ring 65 is constrained to travel with the split ring. Accordingly, as seen by comparing FIGS. 5C and 5D, continued upward movement of member 31 simply carries the combination of piston 47, split ring 46 and retaining ring 65 upwardly through bore portion 17 of member 3, the split ring being held inactive so that there can be no interference with shoulder 20.

THE EMBODIMENT OF FIG. 8

Figure 8:
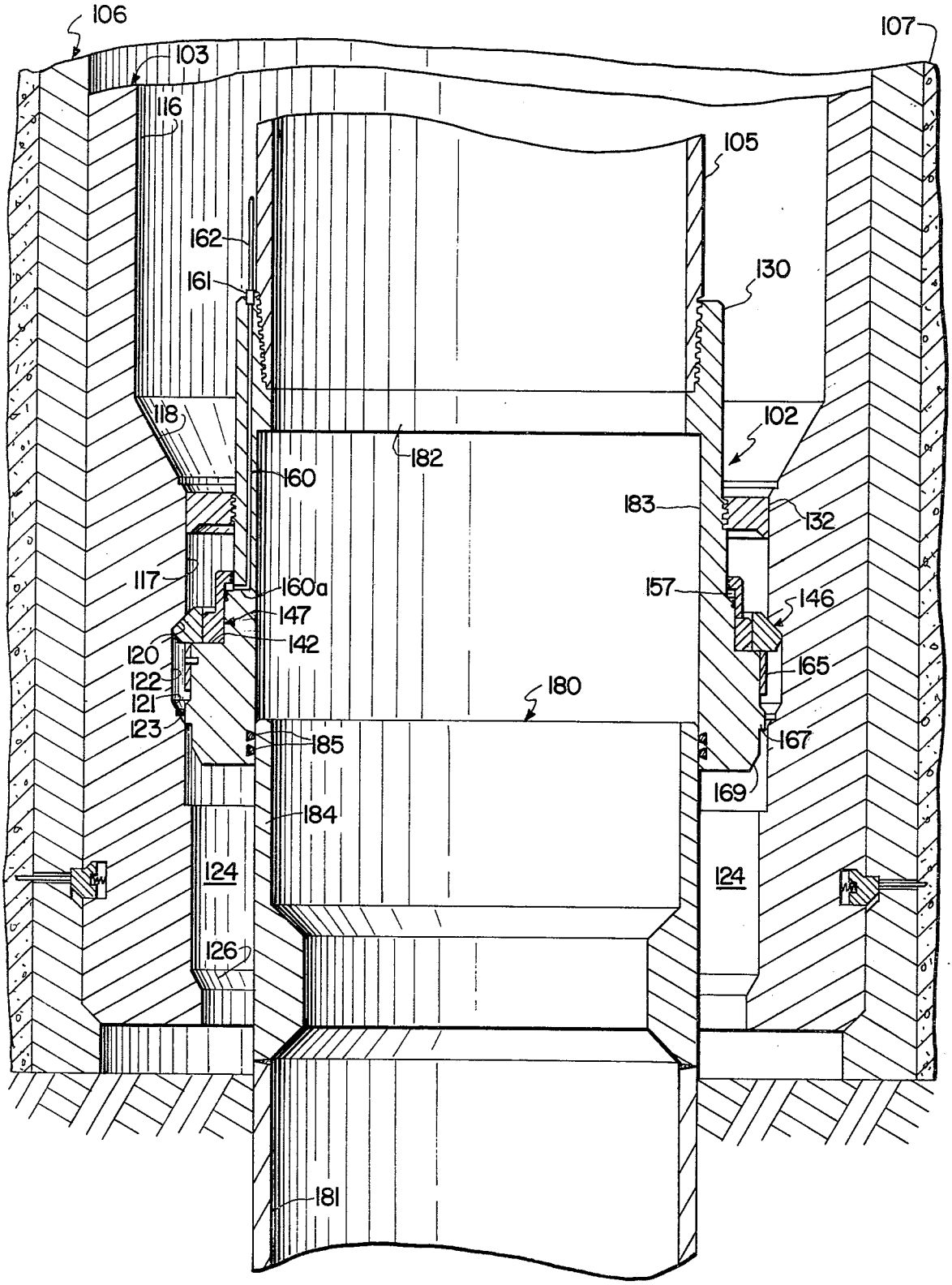
FIG. 8 is a fragmentary vertical sectional view showing the connector of FIGS. 2–7 adapted for connection of a large diameter riser to an anchoring base.

FIG. 8 shows the connector of FIGS. 1–7 adapted for connecting a riser 105, as one tension element of a vertically moored platform, to the anchoring base 107, the connector serving not only as a tension connector for riser 105 but also to form a fluid-tight connection with a weld ring 180 secured to the upper end of a string of outer casing 181 installed in a bore extending below anchoring base 107. Male connector member 102 comprises a single integral tubular body member 130 having its upper end 134 connected by a threaded joint to the lower end of riser 105. Female connector member 103 is similar to member 3, FIGS. 1–6, and has a larger diameter upper bore portion 116, a lower bore portion 117 of smaller diameter and a downwardly tapering frustoconical entry guide surface 118 joining bore portions 116, 117. Bore portion 117 is interrupted by a transverse annular inwardly opening groove defined by upper frustoconical shoulder 120, lower shoulder 121 and a cylindrical outer wall portion 122. Shoulder 121 is frustoconical, tapering downwardly and inwardly at the same angle as does guide surface 118. Surface 118 is provided with transverse annular notch 119 and shoulder 121 is provided with an identical notch 123. Below shoulder 121, bore portion 117 is interrupted by an annular series of three inwardly projecting splines 124 identical with splines 24, FIGS. 1–7, and a stop shoulder 126 is provided immediately below splines 124. Female member 103 is seated within and latched to a tubular receptacle 106 in the same manner described for the embodiment of FIGS. 1–7.

Externally, male body member 130 carries a fixed ring 132, a split ring 146 to serve as the annular stop means, and a blocking piston 147, elements 132, 146 and 147 being identical to elements 32, 46 and 47, respectively, of the embodiment of FIGS. 1–7. Below ring 132, the outer configuration of member 130 is identical to that of member 31 of the embodiment of FIGS. 1–7, so that a shoulder 142 is presented as a lower seat for the split ring and the piston, and an expansible chamber 157 is defined by coacting portions of the piston and body member. Below shoulder 142, ring 165 embraces a cylindrical outer surface portion 139 of body member 130. Below ring 165, body member 130 has three circumferentially spaced male splines 167 which are identical with splines 67 of the embodiment of FIGS. 1–7 and therefore can enter the guideways between female splines 124 only when male connector member 102 occupies one predetermined rotational position with respect to female member 103. At its lower end, body 130 has a peripheral shoulder 169 capable of seating on stop shoulder 126.

A duct 160 extends downwardly from the top of body member 130 and communicates with expansible chamber 157 via a cross duct 160*a*. A pressure fluid conduit 162, extending along the outer surface of riser 105 from top to bottom, is connected to the upper end of duct 160 by a fitting 161.

Body member 130 is generally tubular, presenting a short right cylindrical inner wall portion 182, of the same diameter as the inner wall of riser 105, and an elongated right cylindrical inner wall portion 183 which is of significantly larger diameter than portion 182. Weld ring 180 includes an upwardly projecting tubular portion 184 having an outer diameter such as to be slidably embraceable by inner wall portion 183 of body member 130. Casing 181 is conventionally installed, as by being cemented in a bore hole and weld ring 180 occupies a predetermined position, centered relative to receptacle 106 and therefore relative to female connector member 103, and with the upper end of portion 184 projecting a predetermined distance above stop shoulder 126 of member 103. The length of inner wall portion 183 of body 130 is such that, when split ring 146 is engaged between shoulders 120 and 142, as shown in FIG. 8, the lower end portion of wall portion 183 embraces the upper end portion of upstanding portion 184 of the weld ring. A sliding fluid-tight seal is provided between wall portion 183 and the outer surface of portion 184, as by O-rings 185 carried in transverse annular inwardly opening grooves in body 130.

Operation of the connector is as described for connector 1 in the embodiment of FIGS. 1–7, with the additional feature that, whenever male connector member 102 is lowered into female connector member 103 and manipulated, by manipulation of riser 105 from the surface, to bring split ring 146 into engagement with shoulder 120, so that the connector is made up in tension, the lower end portion of inner wall 183 is telescoped over upstanding portion 184 of the weld ring and O-rings 185 then establish the seal between the male connector member and the weld ring. That seal is preserved until split ring 146 is released from the female connector member, by either the primary release mode described with reference to FIGS. 4 and 4A or the secondary release mode described with reference to FIGS. 5–5D. Considering FIG. 8 in the light of FIGS. 3C–5D, it will be noted that O-rings 185, FIG. 8, will maintain a seal between members 130 and 184 for all operative positions of member 130 prior to disengagement of split ring 146 from shoulder 120.

THE EMBODIMENT OF FIGS. 9–11A

The connector 201 of this embodiment comprises a male connector member 202 and a female connector member 203, the latter being seated in and latched to a receptacle 206 forming part of the anchoring base 207. Male member 202 is connected to, e.g., a string of pipe (not shown) forming one tension element of the leg of a tension leg offshore platform, the connection being made, e.g., in the manner described with reference to FIGS. 1 and 2.

Female member 203 is generally tubular and includes an upper bore portion 216 of larger diameter, a lower bore portion 217 of smaller diameter, and an intermediate frustoconical entry guide surface 218 which tapers downwardly and inwardly to join bore portions 216, 217. Bore portion 217 is interrupted by a transverse annular inwardly opening groove defined by an upper frustoconical wall 220, a lower frustoconical wall 221 which tapers downwardly and inwardly at the same angle as guide surface 218, and an outer right cylindrical wall 222. Below shoulder 221, member 203 has a transverse annular upwardly facing shoulder 225 joining bore portion 217 and a smaller diameter bore portion 217*a* which is interrupted by an annular series of three inwardly projecting splines 224 spaced apart to provide three guideways 224*a*, splines 224 being arranged in the manner described for splines 24 of the embodiment of FIGS. 1–7. Bore portions 217 and 217*a* are joined by a flat transverse annular shoulder 225.

Male member 202 is an integral body having an upstanding central stem 230 and an enlarged portion 231 which presents an upper outer right cylindrical surface portion 232, of a diameter slightly smaller than bore portion 217, an intermediate outer surface portion 239, of a diameter significantly smaller than portion 232, and a lower outer surface portion 239*a* of a diameter markedly smaller than portion 239. Between surface portions 232 and 239, portion 231 of member 202 has a transverse annular outwardly and downwardly opening groove defined by a frustoconical upper wall 243, a frustoconical lower wall 242 and an inner wall 238. Walls 242, 243 are mutually parallel and taper upwardly and inwardly, advantageously at 45°. Wall 238 extends at right angles to walls 242, 243. Surfaces 239 and 239*a* are joined by a flat transverse annular shoulder 239*b*.

Portion 231 carries an annular piston 247 comprising a hub 255, which slidably embraces surface portion 239*a*, and a sleeve member 265 comprising an upwardly projecting portion 265*a*, a downwardly projecting portion 265*b*, and a flat transverse annular inwardly projecting flange 265*c* seated in an annular notch in hub 255, the sleeve member being releasably secured to the hub by shear pins 265*d*. The upper end of portion 265*a* projects beyond shoulder 239*b* and embraces surface portion 239 with sufficient clearance to allow escape of fluid from the space below shoulder 239*b*. Rigidly secured to the lower end of portion 231 of male member 202, as by screws 270, is a generally cup-shaped member 271 the cylindrical side wall 272 of which embraces surface 239*a* below hub 255, O-rings 273 being provided to seal between side wall 272 and surface 239*a*. At its upper end, side wall 272 has an annular outwardly projecting flange 274 slidably embraced by lower portion 265*b* of the sleeve member. Flange 274 is equipped with O-rings 275 to seal between the flange and portion 265*b* of the sleeve member. The inner periphery of hub 255 is equipped with O-rings 276 to seal between the hub and surface 239*a*. Hub 255, sleeve portion 265*b*, flange 274 and surface portion 239*a* thus combine to define an expansible chamber 257. A duct 260 communicates between chamber 257 and an upright bore 261 in member 202, bore 261 opening into the bore of the pipe string (not shown) to which the male connector member is connected.

Figure 9:
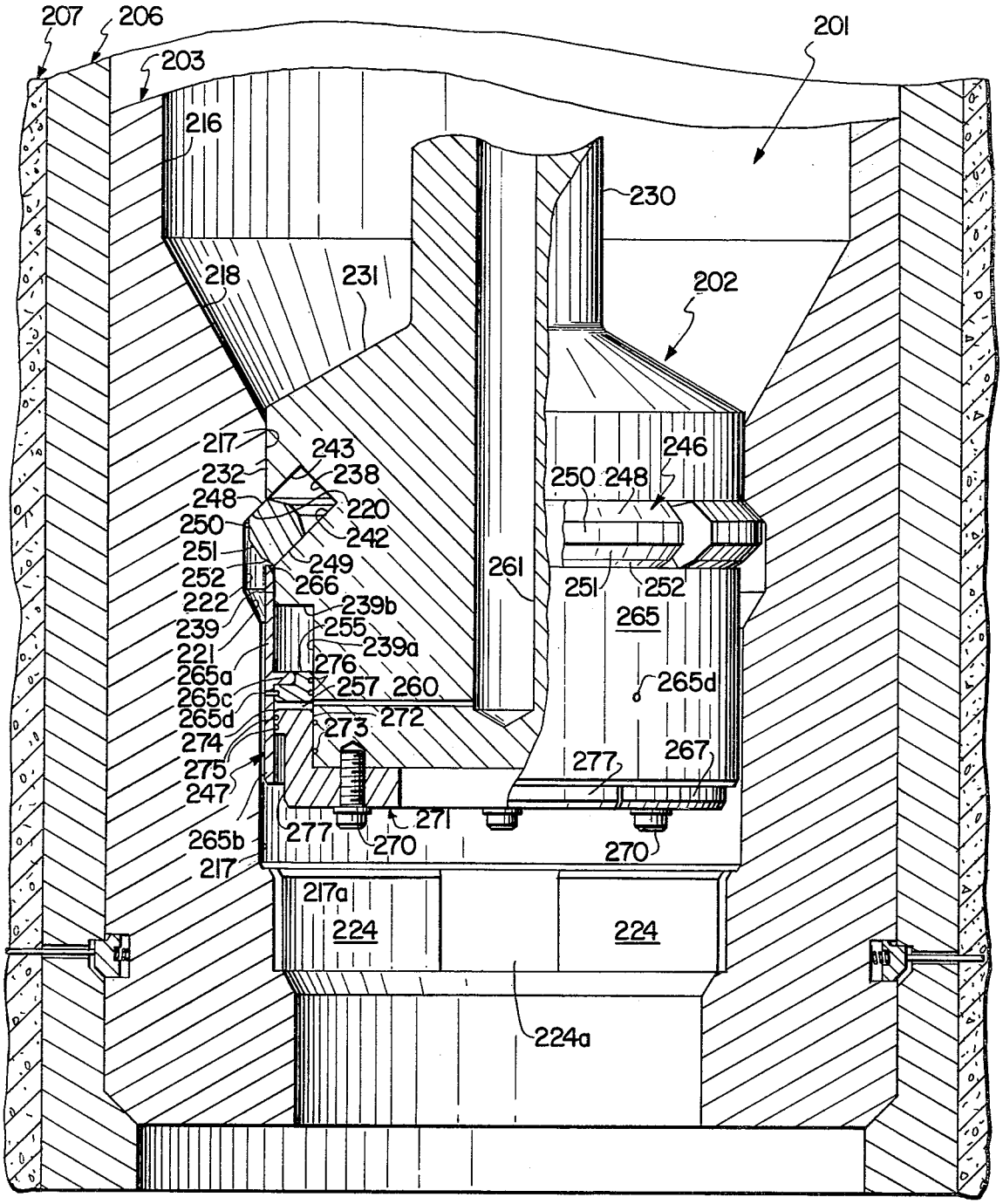
FIG. 9 is a view similar to FIG. 2 illustrating a connector according to another embodiment of the invention.

Slidably retained in the groove defined by walls 238, 242 and 243 is a resilient split ring 246 having an upper frustoconical shoulder 248, a lower frustoconical shoulder 249, a right cylindrical outer surface portion 250, a frustoconical outer surface portion 251 and a lower frustoconical outer surface portion 252. Shoulders 248, 249 taper upwardly and inwardly at the same angle as do shoulder 220 and walls 242, 243. Surface 251 tapers downwardly and inwardly at the same angle as does entry guide surface 218. At its upper end, portion 265*a* of sleeve member 265 has a downwardly and inwardly tapering frustoconical camming surface 266 which tapers at the same angle as does surface 251. When allowed to relax, split ring 246 projects outwardly and downwardly from the groove defined by walls 238, 242 and 243 and assumes the normal undistorted position seen in FIG. 9.

Side wall 272 of member 271 has a right cylindrical outer surface 277 of a diameter such as to be capable of being slidably embraced by the inner surfaces of female splines 224. Surface 277 is interrupted by three outwardly projecting male splines 267, FIG. 9, spaced apart circumferentially and sized and positioned, as heretofore explained with reference to splines 67 of the embodiment of FIGS. 1–7, to enter the guideways 224*a* only when member 202 occupies one predetermined rotational position with respect to member 203 and its splines 224.

Female member 203 can be installed with anchoring base 207, or can be run down with the aid of guide means subsequent to installation of the anchoring base. With member 203 in place, the tension element to which member 202 is attached is run down, with the aid of conventional guide means (not shown), to cause member 202 first to be centered by entry guide surface 218, then to enter bore portion 217. As the male member descends, split ring 246 engages surface 218, and by coaction of surfaces 218 and 251, the split ring is resiliently contracted so that surface 250 of the ring is slidably embraced by the wall of bore portion 217. As the split ring passes shoulder 220, the split ring expands resiliently to its relaxed and undistorted condition, bringing shoulder 248 of the ring into opposition to shoulder 220. When an upward strain is now applied to the pipe string to which member 202 is attached, shoulder 248 of the split ring is urged against shoulder 220 and the tension load is accepted along lines at right angles to shoulders 220, 242, 248 and 249. Thus, with those shoulders tapering at 45°, the entire tension load is applied in compression.

Figure 10:
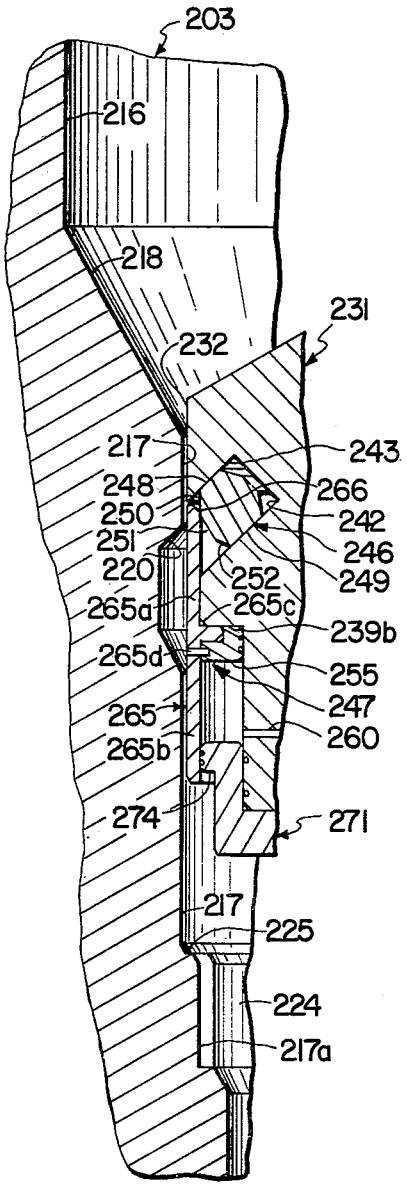
FIG. 10 is a fragmentary vertical sectional view showing relative positions of parts of the connector of FIG. 9 after release according to its primary release mode.

As in the embodiment of FIGS. 1–7, connector 201 can be disconnected remotely by a primary release mode or, if the primary mode fails, by a secondary release mode. For remote disconnection by the primary mode, strain on the string of pipe to which male member 202 is attached is relieved, and hydraulic fluid under pressure is supplied down the bore of the pipe and, via bore 261 and duct 260, to expansible chamber 257. As seen in FIG. 10, supply of pressure fluid to chamber 257 drives piston 247 upwardly, causing surface 266 to engage first surface 252 and then surface 251, thereby camming split ring 246 inwardly until upper portion 265*a* of sleeve 265 embraces outer surface 250 of the split ring. Engagement of hub 255 with shoulder 239*b* stops upward travel of the piston. With split ring 246 thus contracted and held entirely within the groove defined by walls 238, 242 and 243, male member 202 is free to be withdrawn from member 203.

Figure 11:
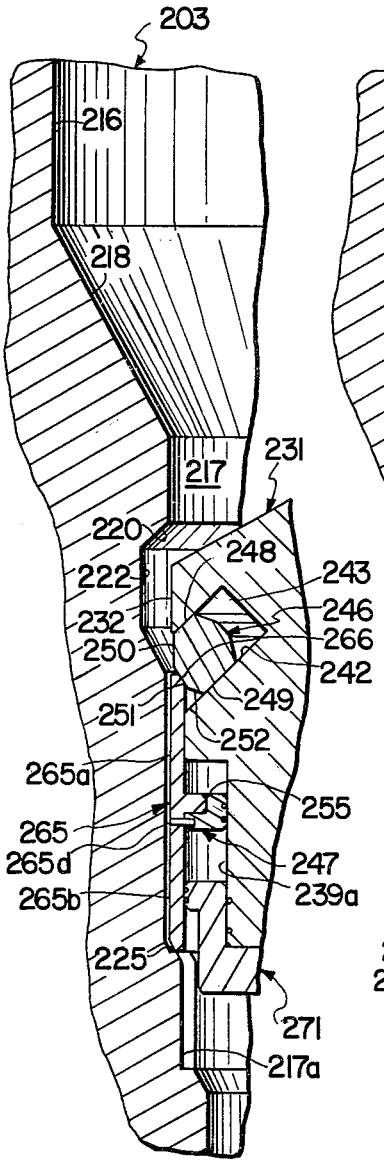
FIGS. 11 and 11A are fragmentary vertical sectional views showing relative positions of parts of the connector of FIG. 9 during release according to its secondary release mode.
Figure 11A:
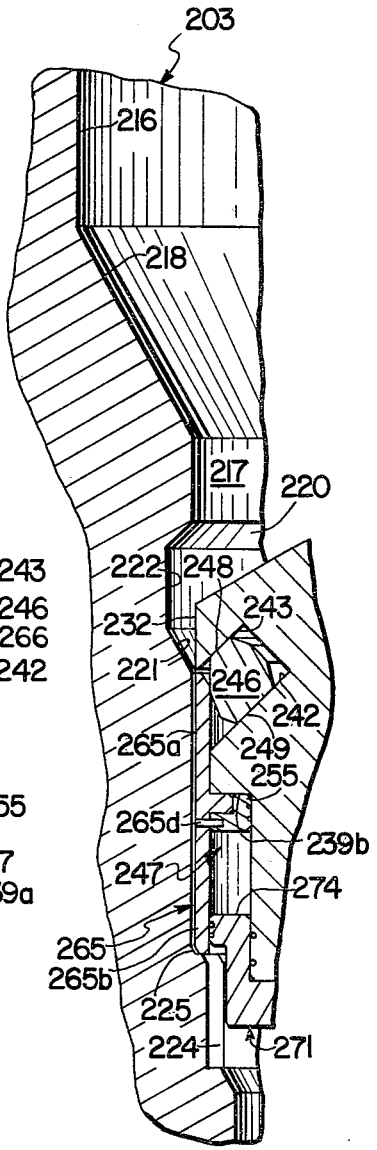

Should the primary release mode fail, the secondary release mode is employed as illustrated in FIGS. 11 and 11A. By manipulating the pipe string to which member 202 is attached, member 202 is moved downwardly within member 203 and adjusted rotationally relative to member 203 until male splines 267 are properly aligned with the respective guideways 224*a* between female splines 224. Continued descent of member 202 now causes the lower end of sleeve member 265 of piston 247 to engage shoulder 225. Then, as shown in FIG. 11, further downward movement of the male member causes body 231 to travel downwardly through the piston so that first surface 252, then surface 251 of the split ring come into camming engagement with surface 266 of sleeve member 265. Continued descent of body 231 then causes the upper end of sleeve member 265 to embrace surface 250 of split ring 246 so the split ring is completely contracted into its retaining groove and held in the groove by the sleeve member. The male connector member is accordingly free to be withdrawn upwardly from the female connector member. Should hub 255 of piston 247 seize on surface 239*a*, the sequence of operations just described causes pin 265*d* to shear, freeing sleeve member 265 from the hub and assuring that the secondary release mode can be carried out.

What is claimed is:

1. In a remotely connectable and remotely releasable connector for securing an elongated generally upright upper member to a lower member in such fashion that large tension loads can be applied from one member to the other via the connector, the combination of a female connector member to be secured to one of the upper member and the lower member and having a bore having a generally cylindrical wall, said bore being open at one end, a generally frustoconical entry guide surface located at said one end, the entry guide surface being concentric with the bore and tapering inwardly and toward the opposite end of the bore, the wall of the bore including a transverse first load-bearing shoulder spaced from the entry guide surface and facing generally toward said opposite end of the bore;

a male connector member to be secured to the other of the upper member and the lower member and having a generally cylindrical outer surface dimensioned to be telescopically disposed in the bore of the female member, and a transverse annular outwardly opening recess defined by a first side wall, a second side wall constituting a second transverse annular load-bearing shoulder, and an inner surface which is generally concentric with the longitudinal axis of the male member and extends between said side walls, said first and second side walls being spaced apart axially of the male connector member with the first side wall being nearer the entry guide surface and the second side wall being farther from the entry guide surface when the male member is so telescopically disposed in the female member that both side walls are with said bore, said second load-bearing shoulder then being so disposed as to face toward said first load-bearing shoulder;

annular stop means disposed in said outwardly opening recess and having a third load-bearing shoulder and a fourth load-bearing shoulder, said third and fourth load-bearing shoulders facing generally away from each other with said fourth shoulder facing toward said second shoulder, the annular stop means being radially distortable between an outer position, in which the stop means has a larger diameter and the outer diameter of said third load-bearing shoulder is substantially greater than the inner diameter of said first load-bearing shoulder, and an inner position, in which the stop means has a smaller diameter and the outer diameter of said third load-bearing shoulder is less than the inner diameter of said first load-bearing shoulder, said third load-bearing shoulder being of such shape and dimensions as to be capable of flush engagement with said first load-bearing shoulder when the lock means is in its outer position, the annular stop means being resiliently biased toward said outer position whereby the stop means will expand to its outer position when not restrained by the bore wall of the female connector member, relative axial movement of the male and female connector members in a direction to bring said members into telescopic engagement causing the annular stop means to engage the entry guide surface of the female connector member, the female connector member, annular stop means and male connector member having coacting means, operative on continuation of the relative movement of the connector members, to contract the annular stop means toward said inner position and thereby allow the stop means to traverse the bore of the female connector member until the stop means reaches said first load-bearing shoulder and can expand under the influence of the resilient bias toward said outer position, whereupon said first and third load-bearing shoulders will then be mutually engaged when a tension load is applied in a direction tending to withdraw the male connector member from the female connector member, at least one of the female connector member, annular stop means and male connector member being constructed and arranged for prevention of movement of the annular stop means toward its inner position when the first and third load-bearing shoulders are mutually engaged and such tension load is applied, whereby such mutual engagement of said first and third load-bearing shoulders prevents relative axial movement of the male and female connector members under such tension load, the transverse dimensions of the male connector member and the bore of the female connector member being such as to allow additional relative axial movement of the connector members in said direction to bring the annular stop means to a position substantially beyond the first load-bearing shoulder; and means carried by one of the connector members and responsive to said additional relative axial movement for at least conditioning the annular stop means for movement to its inner position.

2. The combination defined in claim 1, wherein the outwardly opening annular recess of the male connector member is substantially wider, in a direction axially of the connector member, than is the annular stop means;

the annular stop means presents an annular corner which faces the entry guide surface of the female connector member when the connector members are in positions to commence telescopic engagement;

the entry guide surface of the female connector member is provided with an annular groove dimensioned to receive said annular corner and thereby releasably restrain and centralize the stop means as relative movement between the connector members causes the annular stop means to coact with the entry guide surface;

the male connector member includes a frustoconical camming surface extending along the side of the outwardly opening annular recess opposite said second load-bearing shoulder, said frustoconical camming surface being dimensioned and arranged to slidably embrace said third load-bearing shoulder of the stop means when, the stop means having been restrained by engagement of said corner in said groove, relative axial movement of the male and female connector members is continued, coaction of said frustoconical camming surface and said third load-bearing shoulder causing the annular stop means to contract to withdraw said corner from said groove.

3. The combination defined in claim 2, wherein the annular stop means is a resilient split ring which, when relaxed and undistorted, has a diameter such that the diameter of said annular corner is slightly less than the outer diameter of the annular groove in the entry guide surface.

4. The combination defined in claim 1, wherein the outwardly opening recess of the male member is a transverse annular groove having upper and lower frustoconical side walls which are mutually parallel and also parallel to said first load-bearing shoulder when the male and female connector members are telescopically engaged; and the annular stop means is disposed in said groove with said third and fourth load-bearing shoulders slidably engaging the respective ones of said frustoconical side walls

5. The combination defined in claim 4, wherein the annular stop means has an outer surface portion which is frustoconical and tapers in the same direction and at substantially the same angle as the entry guide surface of the female connector member.

6. The combination defined in claim 5, wherein the means for at least conditioning the annular stop means for disengagement comprises an annular piston slidably embracing the male member and including a nose portion directed toward the stop means for engagement with the frustoconical outer surface portion of the annular stop means, said piston being movable toward the stop means to contract and disengage the stop means in response to supply of fluid pressure.

7. The combination defined in claim 6, wherein the female coupling member is provided with abutment means exposed within said bore and spaced axially from said first load-bearing shoulder; and said piston is provided with a second nose portion disposed to be brought into engagement with said abutment means by axial movement of the male connector member in said bore, whereby said piston can be actuated to contract and disengage the annular stop means solely by moving the male connector member in event of failure of the piston to move in response to supply of fluid pressure.

8. The combination defined in claim 1, wherein the means for at least conditioning the annular stop means for disengagement comprises blocking means disposed for movement between an active position, in which the blocking means prevents disengagement of the annular stop means, and an inactive position allowing such disengagement, fluid pressure operated means for moving the blocking means to its inactive position, coacting means on the female connector member, the annular stop means and the male connector member whereby relative axial movement of the connector members in one direction causes the annular stop means to be contracted from said outer position toward said inner position and thereby disengaged from said first load-bearing shoulder, and means responsive to further relative movement of the connector members in said one direction for retaining the annular stop means contracted in disengaged position.

9. The combination defined in claim 8, wherein said coacting means comprises a retaining sleeve embracing the cylindrical outer surface of the male connector member in an initial position adjacent said second load-bearing shoulder and having an end spaced from said second load-bearing shoulder, and an internal shoulder on the female connector member disposed to be engaged by said end of the retaining sleeve as a result of relative axial movement between the male and female connector members, whereby when the annular stop means has been contracted to its inner position the retaining sleeve can be displaced relative to the male connector member to embrace the stop means and retain the stop means in its inner position.

10. The combination defined in claim 9, wherein the male connector member includes a portion which projects beyond said end of the retaining sleeve when the sleeve is in said initial position, said portion of the male connector member having at least one outwardly projecting spline; and the female connector member includes guideway-defining means disposed to accommodate the at least one spline of the male connector member only when the male connector member occupies a predetermined rotational position relative to the female connector member.

11. The combination defined in claim 12, wherein the female member has an internal stop shoulder disposed to be engaged by the male connector member to limit relative axial movement of the connector members in that direction causing displacement of the retaining sleeve.

12. The combination defined in claim 11, wherein the means for at least conditioning the annular stop means for disengagement from said first load-bearing shoulder comprises an annular piston carried by the male connector member; and the retaining sleeve constitutes part of the annular piston.

13. The combination defined in claim 12, wherein the male connector member comprises a transverse annular shoulder spaced from the annular recess in which the stop means is disposed, a cylindrical outer surface portion extending away from said last-mentioned shoulder, and means spaced from said last-mentioned shoulder and presenting a transverse annular wall spaced from and opposed to said last-mentioned shoulder; and the piston comprises an annular hub secured to and projecting radially inwardly from the retaining sleeve in a location intermediate between the ends of the retaining sleeve, the annular hub slidably embracing the cylindrical surface between said last-mentioned shoulder and said wall;

the length of the retaining sleeve being such that the sleeve embraces both said annular wall and said last-mentioned shoulder for all positions of the piston determined by the axial distance between said wall and said last-mentioned shoulder and the axial thickenss of the hub.

14. The combination defined in claim 13, wherein the retaining sleeve is secured to the hub by shearable means, whereby the retaining sleeve can be displaced to embrace the annular stop means even if conditions are such that the hub cannot be moved axially relative to the male connector member.

15. The combination defined in claim 1, wherein the annular stop means is a resilient metal split ring which occupies its outer position when relaxed and undistorted; and the male connector member has camming means located to engage the split ring and contract the ring to its inner position as a result of relative axial movement of the female connector member in said direction to bring the male and female connector members into telescopic engagement when the split ring is engaged with the entry guide surface of the female connector member.

16. In mooring means for a tension leg platform, the combination of an anchoring base installed at the bottom of a body of water;

a mooring leg comprising a tension element in the form of a string of pipe extending from the surface of the body of water to the anchoring base;

a male connector member secured to the lower end of the string of pipe;

an upright generally tubular female connector member secured to the anchoring base and opening upwardly to receive the male connector member, the female connector member having a cylindrical inner wall portion, and a transverse annular inwardly opening groove, the upper wall of the groove constituting a first transverse annular load-bearing shoulder which faces generally downwardly;

the male connector member having a transverse annular recess which opens generally outwardly, the lower wall of the recess constituting a second transverse annular load-bearing shoulder which faces generally upwardly so as to be opposed to the first load-bearing shoulder when the male connector member has been inserted downwardly into the female connector member, annular stop means disposed in the outwardly opening recess and having a generally upwardly directed third load-bearing shoulder adapted to mate with the first load-bearing shoulder and a generally downwardly directed fourth load-bearing shoulder adapted to mate with the second load-bearing shoulder, the annular stop means being resiliently contractible and expansible between an outer position, in which the stop means projects radially outwardly from the recess, and an inner position, in which the stop means is housed within the recess, the annular stop means being resiliently biased toward its outer position;

the male connector member being connectable to the female connector member in tension solely by manipulating the string of pipe to cause the male connector member to enter the female connector member with the annular stop means first being contracted to allow the male connector member to descend until the stop means is effectively below the first load-bearing shoulder and then expanded under the influence of the resilient bias to its outer position so that an upward strain on the string of pipe will then cause the annular stop means to be engaged between the first and second load-bearing shoulders, at least one of the female connector member, annular stop means and male connector member being constructed and arranged for prevention of movement of the annular stop means toward its inner position when the stop means is engaged between the first and second load-bearing shoulders; and remote release means comprising elements carried by at least one of the male connector member and the female connector member and operable remotely to at least condition the annular stop means for release from its engagement between the first and second load-bearing shoulders preparatory to remote release of the male connector member from the female connector member.

17. The combination defined in claim 16, wherein the remote release means comprises first means operable by hydraulic pressure for at least conditioning the annular stop means for release, and second means operable by manipulation of the string of pipe for positively contracting the annular stop means to its inner position.

18. in a remotely operated connector for securing an upper member, such as a string of pipe, to a lower member, such as an anchoring base installed at the bottom of a body of water, the combination of a male connector member connectable to the lower end of the upper member;

an upright generally tubular female connector member adapted to be secured to the lower member and then to open upwardly to receive the male connector member, the female connector member having a generally cylindrical inner wall portion, and a transverse annular inwardly opening groove in said wall portion, the upper wall of the groove constituting a transverse annular first load-bearing shoulder which faces generally donwardly;

the male connector member having a transverse annular recess which opens generally outwardly, the bottom of the recess constituting a second transverse annular load-bearing shoulder which faces generally upwardly so as to be opposed to the first load-bearing shoulder when the male connector member has been inserted downwardly into the female connector member to bring the second load-bearing shoulder below the first load-bearing shoulder, annular stop means disposed in the outwardly opening recess and being contractible and expansible between an outer active position and an inner inactive position, the stop means being resiliently biased toward its active position and dimensioned to pass through said inner wall portion of the female connector member when the stop means is in its inactive position, the stop means having a generally upwardly directed third load-bearing shoulder adapted to mate with the first load-bearing shoulder and a generally downwardly directed fourth load-bearing shoulder adapted to mate with the second load-bearing shoulder;

the male connector member being connectable to the female connector member in tension by manipulating the upper member to cause the male connector member to enter the female connector member with the annular stop means being first contracted to its inactive position to allow the male connector member to descend until the stop means is effectively below the first load-bearing shoulder and then expanded to its active position so that an upward strain on the upper member will then cause the stop means to be engaged between the first and second load-bearing shoulders, at least one of the female connector member, annular stop means and male connector member being constructed and arranged for prevention of movement of the annular stop means toward its inner position when the stop means is engaged between the first and second load-bearing shoulders;

an abutment carried by the female connector member in a location below the first load-bearing shoulder; and a retaining ring surrounding the male connector member in a location above said abutment, said abutment being disposed within said female connector member and positioned to limit downward movement of said retaining ring relative to the female connector member, a portion of the male connector member being dimensioned to move downwardly through said retaining ring and beyond said abutment, whereby manipulation of the upper member to cause such downward movement of the male connector member will move the annular stop means downwardly to be embraced by the retaining ring, the inner diameter of the retaining ring being sufficiently small that, when the annular stop means is embraced by the retaining ring, the outer diameter of the annular stop means is smaller than said inner wall portion of the female connector member and the male connector member can therefore be withdrawn upwardly from the female connector member without interference between the first load-bearing shoulder and the annular stop means.

19. The combination defined in claim 18, wherein said retaining ring has an upwardly directed camming surface disposed to be engaged by the annular stop means as a result of downward movement of the male connector member, downward movement of the male connector member adequate to move the annular stop means downwardly beyond said camming surface causing said camming surface to coact with the annular stop means to contract the same toward its inactive position, causing the annular lock means to be embraced by the retaining ring.

20. In a remotely connectable and remotely releasable connector for securing an elongated generally upright upper member to a lower member in such fashion that large tension loads can be applied from one member to the other via the connector, the combination of a female connector member to be secured to one of the upper member and the lower member and having a bore having a generally cylindrical wall, said bore being open at one end, a generally frustoconical entry guide surface located at said one end, the entry guide surface being concentric with the bore and tapering inwardly and toward the opposite end of the bore, the wall of the bore including a transverse first load-bearing shoulder spaced from the entry guide surface, said shoulder being generally frustoconical and tapering inwardly toward said one end of the bore and facing generally toward the opposite end of the bore;

a male connector member to be secured to the other of the upper member and the lower member and having a generally cylindrical outer surface dimensioned to be telescopically disposed in the bore of the female member, and a transverse annular outwardly opening recess defined by a first side wall, a second side wall constituting a second transverse annular load-bearing shoulder, and an inner surface which is generally concentric with the longitudinal axis of the male member and extends between said side walls, said first and second side walls being spaced apart axially of the male connector member with the first side wall being nearer the entry guide surface and the second side wall being farther from the entry guide surface when the male member is so telescopically disposed in the female member that both side walls are within said bore, said second load-bearing shoulder then being so disposed as to face toward said first load-bearing shoulder;

annular stop means disposed in said outwardly opening recess and having a third load-bearing shoulder and a fourth load-bearing shoulder which face generally away from each other with said fourth shoulder facing toward said second shoulder, the annular stop means being radially distortable between an outer position, in which the stop means has a larger diameter and the outer diameter of said third load-bearing shoulder is substantially greater than the inner diameter of said first load-bearing shoulder, and an inner position, in which the stop means has a smaller diameter and the outer diameter of said third load-bearing shoulder is less than the inner diameter of said first load-bearing shoulder, said third load-bearing shoulder being generally frustoconical and tapering in the same direction sand at substantially the same angle as does the first load-bearing shoulder so that the third load-bearing shoulder is capable of flush engagement with said first load-bearing shoulder when the lock means is in its outer position, the annular stop means being resiliently biased toward said outer position whereby the stop means will expand to its outer position when not restrained by the bore wall of the female connector member, relative axial movement of the male and female connector members in one direction to bring said members into telescopic engagement causing the annular stop means to engage the entry guide surface of the female connector member, the female connector member, annular stop means and male connector member having coacting means, operative on continuation of the relative movement of the connector members to contract the annular stop means toward said inner position and thereby allow the stop means to traverse the bore of the female connector member until the stop means reaches said first load-bearing surface and can expand under the influence of the resilient bias toward said outer position, whereupon said first and third load-bearing shoulders will then be mutually engaged when a tension load is applied in a direction tending to withdraw the male connector member from the female connector member; and remotely operable means comprising fluid pressure operated blocking means movable axially of the male connector member between an active position, in which the blocking means is engaged within the annular stop means to prevent the stop means from contracting toward said inner position, and an inactive position, in which the blocking means is disengaged from the stop means;

said second and fourth load-bearing shoulders lying in planes generally at right angles to the longitudinal axis of the male connector member, whereby tension applied to the connector while the blocking means is in its inactive position causes the stop means to be cammed toward its inner position by interaction between said first and third load-bearing shoulders so that the first and third load-bearing shoulders are disengaged and the connector members are freed to be telescopically disengaged.

21. The combination defined in claim 20, wherein the outwardly opening annular recess of the male connector member is substantially wider, in a direction axially of the connector member, than is the annular stop means and has an inner wall of substantial axial length; and the fluid pressure operated blocking means is an annular piston embracing the inner wall of the outwardly opening recess, the width of the piston being substantially smaller than the axial width of the outwardly opening recess, the piston being movable, axially of the male connector member, from its active position to its inactive position as a result of admission of fluid under pressure to an expansible chamber defined by the piston and the inner wall of said recess.

* * * * *